US010017312B2

(12) United States Patent
Oguchi et al.

(10) Patent No.: US 10,017,312 B2
(45) Date of Patent: Jul. 10, 2018

(54) BOTTLE

(71) Applicants: Hiroki Oguchi, Tokyo (JP); Goro Kurihara, Tokyo (JP)

(72) Inventors: Hiroki Oguchi, Tokyo (JP); Goro Kurihara, Tokyo (JP)

(73) Assignee: YOSHINO KOGYOSHO CO., LTD., Tokyo (JP)

( * ) Notice: Subject to any disclaimer, the term of this patent is extended or adjusted under 35 U.S.C. 154(b) by 0 days.

(21) Appl. No.: 14/375,954

(22) PCT Filed: Feb. 27, 2013

(86) PCT No.: PCT/JP2013/055151
§ 371 (c)(1),
(2) Date: Jul. 31, 2014

(87) PCT Pub. No.: WO2013/129480
PCT Pub. Date: Sep. 6, 2013

(65) Prior Publication Data

US 2015/0041426 A1 Feb. 12, 2015

(30) Foreign Application Priority Data

Feb. 29, 2012 (JP) ..... 2012-043363
Jul. 31, 2012 (JP) ..... 2012-170598
(Continued)

(51) Int. Cl.
*B65D 79/00* (2006.01)
*B65D 1/02* (2006.01)

(52) U.S. Cl.
CPC ..... *B65D 79/005* (2013.01); *B65D 1/0223* (2013.01); *B65D 1/0276* (2013.01); *B65D 2501/0018* (2013.01)

(58) Field of Classification Search
CPC ..... B65D 1/00; B65D 1/06; B65D 1/0261; B65D 2501/0027; B29C 49/4815; B29C 49/54; B29C 49/541; B29C 2049/4892
(Continued)

(56) References Cited

U.S. PATENT DOCUMENTS 4,877,141 A * 10/1989 Hayashi et al. ..... 215/381
5,064,081 A 11/1991 Hayashi et al.
(Continued)

FOREIGN PATENT DOCUMENTS

CN 1467131 A 1/2004
CN 101678911 A 3/2010
(Continued)

OTHER PUBLICATIONS

International Search Report issued in International Application No. PCT/JP2013/055151 dated May 21, 2013 (with translation).
(Continued)

*Primary Examiner* — Ernesto Grano
(74) *Attorney, Agent, or Firm* — Oliff PLC

(57) ABSTRACT

A bottle includes a cylindrical body portion in which a plurality of panel portions, which is recessed toward an inside in a radial direction of the body portion, are provided at intervals in a circumferential direction and pillar portions are each provided between the panel portions adjacent to each other in the circumferential direction. The panel portions each have a panel bottom wall portion located at an inside of the body in the radial direction and have a lateral wall portion extending from an outer circumferential edge of the panel bottom wall portion to an outside in the radial direction. A rib which protrudes toward the outside in the radial direction while having a gap with respect to the panel bottom wall portion is provided at the panel bottom wall
(Continued)

portion, and a longitudinal lateral wall portion is at least directed in the circumferential direction.

20 Claims, 15 Drawing Sheets

(30) Foreign Application Priority Data

Jul. 31, 2012 (JP) ..... 2012-170599
Oct. 31, 2012 (JP) ..... 2012-240544

(58) Field of Classification Search
USPC ..... 215/375, 382, 376, 371
See application file for complete search history.

(56) References Cited

U.S. PATENT DOCUMENTS

| | | | | |
|---|---|---|---|---|
| 5,238,129 | A * | 8/1993 | Ota | 215/381 |
| 5,341,946 | A * | 8/1994 | Vailliencourt et al. | 215/381 |
| 5,385,250 | A * | 1/1995 | Pasquale | 215/374 |
| 5,407,086 | A | 4/1995 | Ota et al. | |
| 5,704,504 | A | 1/1998 | Bueno | |
| 5,988,417 | A * | 11/1999 | Cheng et al. | 215/383 |
| 6,036,037 | A * | 3/2000 | Scheffer et al. | 215/381 |
| 6,062,409 | A | 5/2000 | Eberle | |
| 6,112,925 | A * | 9/2000 | Nahill et al. | 215/382 |
| 6,164,474 | A * | 12/2000 | Cheng et al. | 215/384 |
| 6,347,717 | B1 | 2/2002 | Eberle | |
| D465,158 | S * | 11/2002 | Peek et al. | D9/538 |
| 6,585,125 | B1 | 7/2003 | Peek | |
| 6,763,968 | B1 * | 7/2004 | Boyd et al. | 220/608 |
| D494,022 | S * | 8/2004 | Bodum | D7/608 |
| D499,603 | S * | 12/2004 | Nikkhah | D7/378 |
| D503,341 | S * | 3/2005 | Delmotte | D9/538 |
| D506,142 | S * | 6/2005 | Gauthier | D9/560 |
| 7,137,520 | B1 * | 11/2006 | Melrose | 215/381 |
| 7,178,684 | B1 * | 2/2007 | Budden et al. | 215/381 |
| D541,106 | S * | 4/2007 | Spiegel | D7/510 |
| D546,700 | S * | 7/2007 | Bourne | D9/552 |
| 7,296,702 | B2 * | 11/2007 | Tanaka et al. | 215/383 |
| D584,628 | S * | 1/2009 | Lepoitevin | D9/538 |
| D592,455 | S * | 5/2009 | Germann | D7/510 |
| D602,783 | S * | 10/2009 | Lepoitevin | D9/538 |
| 7,694,842 | B2 * | 4/2010 | Melrose | 220/666 |
| D630,515 | S * | 1/2011 | Bretz et al. | D9/520 |
| 7,861,876 | B2 * | 1/2011 | Stowitts | 215/381 |
| 7,900,425 | B2 * | 3/2011 | Bysick et al. | 53/440 |
| 7,980,407 | B2 * | 7/2011 | Shimada | 220/62.22 |
| D647,804 | S * | 11/2011 | Yourist et al. | D9/538 |
| 8,091,720 | B2 * | 1/2012 | Colloud | 215/384 |
| 8,162,162 | B2 * | 4/2012 | Hata et al. | 215/382 |
| 8,256,634 | B2 | 9/2012 | Tanaka | |
| D668,157 | S * | 10/2012 | Colloud | D9/538 |
| 8,276,774 | B2 * | 10/2012 | Patcheak et al. | 215/373 |
| 8,286,814 | B2 * | 10/2012 | Pritchett, Jr. | 215/381 |
| D671,007 | S * | 11/2012 | Lovelace et al. | D9/516 |
| 8,556,098 | B2 * | 10/2013 | Peykoff et al. | 215/384 |
| 8,820,555 | B2 * | 9/2014 | Tanaka et al. | 215/381 |
| 8,919,587 | B2 * | 12/2014 | Howell et al. | 215/381 |
| 9,027,770 | B2 * | 5/2015 | Tanaka et al. | 215/382 |
| 2001/0030166 | A1 * | 10/2001 | Ozawa et al. | 215/381 |
| 2001/0037992 | A1 * | 11/2001 | Tanabe et al. | 215/384 |
| 2004/0200799 | A1 | 10/2004 | Yourist et al. | |
| 2005/0067370 | A1 * | 3/2005 | Tanaka et al. | 215/382 |
| 2005/0121409 | A1 * | 6/2005 | Penny et al. | 215/384 |
| 2006/0186082 | A1 | 8/2006 | Gatewood et al. | |
| 2006/0186083 | A1 * | 8/2006 | Joshi et al. | 215/381 |
| 2007/0158294 | A1 * | 7/2007 | Tanaka et al. | 215/43 |
| 2007/0170143 | A1 * | 7/2007 | Shmagin | 215/381 |
| 2008/0314862 | A1 * | 12/2008 | Matsuoka et al. | 215/382 |
| 2009/0159556 | A1 | 6/2009 | Patcheak et al. | |
| 2009/0184127 | A1 | 7/2009 | Mooney | |
| 2009/0261058 | A1 * | 10/2009 | Pritchett, Jr. | B65D 1/0223 215/381 |
| 2009/0321383 | A1 * | 12/2009 | Lane | 215/382 |
| 2010/0320218 | A1 * | 12/2010 | Tanaka | 220/721 |
| 2010/0326951 | A1 * | 12/2010 | Coley et al. | 215/384 |
| 2011/0132863 | A1 * | 6/2011 | Dorn | 215/10 |
| 2011/0233166 | A1 | 9/2011 | Hiromichi et al. | |
| 2012/0228312 | A1 * | 9/2012 | Sutherland | 220/669 |

FOREIGN PATENT DOCUMENTS

| | | | |
|---|---|---|---|
| CN | 102216162 | A | 10/2011 |
| JP | A-7-10147 | | 1/1995 |
| JP | 2002-362525 | A | 12/2002 |
| JP | A-2004-262500 | | 9/2004 |
| JP | 2008-539141 | A | 11/2008 |
| JP | 2008-296920 | A | 12/2008 |
| JP | A-2009-35263 | | 2/2009 |
| JP | A-2009-179358 | | 8/2009 |
| JP | A-2010-275007 | | 12/2010 |
| JP | A-2010-285207 | | 12/2010 |
| JP | 2011-098780 | A | 5/2011 |
| JP | A-2011-230823 | | 11/2011 |
| WO | 97/014617 | A1 | 4/1997 |
| WO | 2006/118584 | A1 | 11/2006 |
| WO | WO 2010/061758 | A1 | 6/2010 |

OTHER PUBLICATIONS

Sep. 11, 2015 Supplementary Search Report issued in European Patent Application No. 13754235.3.

Jun. 7, 2016 Office Action issued in Japanese Patent Application No. 2012-240544.

Nov. 24, 2015 Office Action issued in Japanese Patent Application No. 2012-043363.

Mar. 22, 2016 Office Action issued in Japanese Patent Application No. 2012-170598.

Apr. 23, 2015 Office Action issued in Chinese Patent Application No. 201380007853.1.

Sep. 27, 2017 Office Action Issued in U.S. Appl. No. 14/858,807.

* cited by examiner

BOTTLE

FIELD OF THE INVENTION

The present invention relates to a bottle.

Priority is claimed on Japanese Patent Application No. 2012-43363, filed on Feb. 29, 2012, No. 2012-170598, filed on Jul. 31, 2012, No. 2012-170599, filed on Jul. 31, 2012, and No. 2012-240544, filed on Oct. 31, 2012, the contents of which are incorporated herein by reference.

DESCRIPTION OF RELATED ART

Conventionally, as a bottle formed of a synthetic resin material in a bottomed cylindrical shape, for example, a bottle set forth in Patent Document 1 is known. The bottle of Patent Document 1 has a constitution in which a cylindrical body has a plurality of panel portions that are depressed toward an inside of the body in a radial direction and are formed at intervals in a circumferential direction, and pillar portions each provided between the panel portions adjacent to each other in the circumferential direction.

According to the constitution, for instance, when the temperature of contents sealed in the bottle is lowered, and a pressure in the bottle is reduced, the panel portions are preferentially deformed toward the inside of the body in the radial direction. Thereby, the pressure in the bottle is configured to be absorbed while suppressing deformation at portions of the bottle other than the panel portions.

Further, for example, as disclosed in Patent Document 2, a constitution in which a plurality of annular grooves are provided along an outer surface of a body in order to increase a pressure reduction intensity of the bottle is known.

Further, for example, as disclosed in Patent Document 3, a bottle formed of a synthetic resin material in a bottomed cylindrical shape is known. The bottle disclosed in Patent Document 3 includes a grounding portion that is located at an outer circumferential edge of a bottom wall portion of a bottom portion, a standing peripheral wall portion that is continuous with a radial inside of the grounding portion of the bottle and extends upward, a movable wall portion that has an annular shape and protrudes from an upper end of the standing peripheral wall portion toward the inside in the radial direction and a recessed circumferential wall portion that extends upward from a radial inner end of the movable wall portion. The bottle disclosed in Patent Document 3 has a constitution in which the movable wall portion rotates around a portion connected to the standing peripheral wall portion so as to cause the recessed circumferential wall portion to move upward, thereby absorbing a reduced pressure in the bottle.

Further, in the bottle of Patent Document 3, a plurality of peripheral grooves, which are depressed toward the inside in the radial direction and continuously extend throughout the periphery, are formed in a body at intervals in a bottle axial direction, thereby enhancing radial rigidity.

PRIOR ART DOCUMENT

Patent Document

Patent Document 1: Japanese Unexamined Patent Application, First Publication No.

Patent Document 2: Japanese Unexamined Patent Application, First Publication No. 2004-262500

Patent Document 3: PCT International Publication No. WO2010/061758

SUMMARY OF THE INVENTION

Problems to be Solved by the Invention

In the aforementioned bottle, a label is attached to the body for the purpose of indicating a trade name and contents, and improving design. Such labels include, for instance, a shrink label, a stretch label, a roll label, or a tack label.

However, in the prior art set forth in Patent Document 1, the panel portions are depressed toward the inside in the radial direction. For this reason, particularly, in the case of using the shrink label, even in a bottle having a circular shape in a plan view, a mounted state of the label on the body becomes a substantially polygonal shape such that a portion covering the pillar portion becomes an angular portion, and a portion covering the panel portion becomes a side portion.

Further, in the conventional bottles as in Patent Documents 2 and 3, when the label is adhered to the body, there is a possibility that the label will exhibit an undulated appearance in the bottle axial direction by following a shape of the peripheral groove. In this way, the conventional bottle may generate a sense of discomfort (poor appearance) from the appearance of the label.

To prevent the generation of the poor appearance mentioned above, if a panel width is reduced in the circumferential direction of the panel portions, displacement of the panel portions is reduced when a pressure of the bottle is reduced, and there is a possibility that desired pressure reduction-absorbing performance cannot be exerted.

In other words, to further improve the pressure reduction-absorbing performance, when a constitution in which a plurality of panel portions recessed toward the inside in the radial direction are formed on the body at intervals in a circumferential direction is employed, crimps may occur in the label adhered to the body, and a sense of discomfort may occur with the appearance of the label.

The present invention has been made in view of the aforementioned circumstances, and an object of the present invention is to provide a bottle capable of preventing poor appearance from being generated in a label attached to a body of the bottle while being maintained a desired pressure reduction-absorbing performance.

Means for Solving the Problems

According to a first aspect of the present invention, a bottle having a cylindrical body portion in which a plurality of panel portions, which is recessed toward an inside in a radial direction of the body portion, are provided at intervals in a circumferential direction and in which pillar portions are each provided between the panel portions adjacent to each other in the circumferential direction. The panel portions each have a panel bottom wall portion located at an inside of the body in the radial direction and have a lateral wall portion extending from an outer circumferential edge of the panel bottom wall portion to an outside in the radial direction, and a rib which protrudes toward the outside in the radial direction while having a gap with respect to a longitudinal lateral wall portion of the lateral wall portion is provided at the panel bottom wall portion, the longitudinal lateral wall portion is at least directed in the circumferential direction.

According to the first aspect, when a pressure in the bottle is reduced, the panel bottom wall portion is displaced toward the inside of the body in the radial direction centering on a connecting portion between the panel bottom wall portion and the lateral wall portion at the panel portion. In other words, the panel portions are preferentially deformed when the pressure is reduced, and it is possible to absorb a change in internal pressure (a reduction in pressure) of the bottle while suppressing deformation at other regions.

Moreover, according to the first aspect, the rib protruding toward the outside in the radial direction is arranged at the panel bottom wall portion. For this reason, the label mounted on the body so as to cover the panel portions can be supported by the body from the inside in the radial direction. Therefore, it is possible to restrict the label covering the panel portions from moving to the inside in the radial direction when the label is mounted. Thereby, it is possible to prevent the label from being pulled into the panel portions, and to prevent the label from having a poor appearance. Further, even when the panel portions are deformed toward the inside in the radial direction during the reduction in pressure, the displacement of the label is suppressed. As a result, it is possible to prevent the label mounted on the body from having a poor appearance while being maintained a desired pressure reduction-absorbing performance.

According to a second aspect of the present invention, in the bottle of the first aspect, the panel portions formed at intervals in the circumferential direction may be four Or more.

With the above constitution, since the four or more panel portions are formed in the circumferential direction, the eight or more gaps are each formed between the rib and the longitudinal lateral wall portion in the circumferential direction. Thereby, the body is easily deformed to be reduced in diameter while narrowing the aforementioned gap in the circumferential direction, and the body can be provided with pressure reduction-absorbing performance. As a result, it is possible to prevent the body from being incorrectly deformed to generate angular portions when the pressure of the bottle is reduced, and to reliably maintain a good appearance of the label. Accordingly, since displacement of the label is suppressed even when the panel portions are deformed during the reduction in pressure, the body can be provided with the pressure reduction-absorbing performance while preventing a sense of discomfort from occurring with the appearance of the label.

Furthermore, the four or more panel portions are formed in the circumferential direction, i.e., the ribs and the pillar portions are formed to total eight or more. Thereby, an opening width of each gap can be reduced. In addition, a supporting area of the label caused by the ribs and the pillar portions is secured, and a circumferential length of a gap-covering portion of the label wrapped around the body can be reduced. For this reason, a difference between a length from a portion of the label which covers the rib and the pillar portion to a bottle axis in the radial direction and a length from the portion of the label which covers the gap to the bottle axis can be suppressed.

Further, the four or more panel portions are formed in the circumferential direction. Thereby, it is possible to prevent a circumferential length of the visually recognizable label from differing on the body at each of different points of view in the circumferential direction. As a result, the appearance of the label wrapped around the body can be maintained well without the sense of discomfort.

According to a third aspect of the present invention, in the bottle of the first or second aspect, the rib may be formed throughout a length of the panel bottom wall portion in a direction of a bottle axis. The rib may include a top wall portion located at the outside in the radial direction, and peripheral end wall portions configured to connect circumferential outer ends of the top wall portion and the panel bottom wall portions. The top wall portion of the rib may have an outer surface located on a virtual circle when viewed in a transverse section in the radial direction. The vertical circle may connect outer surfaces of the top parts of the plurality of pillar portions in the circumferential direction.

With the above constitution, since the rib is formed throughout a length of the panel bottom wall portion in a direction of a bottle axis, the label can be supported throughout in the direction of the bottle axis by a portion overlapping the rib when viewed in the radial direction. Thereby, it is possible to reliably suppress crimps from being generated in the label.

Since the supporting area of the label on the body can be secured by the ribs and the pillar portions, it is possible to reliably prevent the sense of discomfort from occurring with the appearance of the label.

Accordingly, the body can be provided with the pressure reduction-absorbing performance while preventing the sense of discomfort from occurring with the appearance of the label.

In particular, since the top surface of the rib is located on the virtual circle extending in the circumferential direction according to the surface shape of each top part of the plurality of pillar portions, the label can be supported on the same surface as the pillar portion at the rib. Thereby, in the label portion covering the panel portions, the displacement of the label portion toward the inside in the radial direction can be reliably regulated.

According to a fourth aspect of the present invention, in the bottle according to any one of the first to third aspects, a position of a radial inner end of the longitudinal lateral wall portion and a position of a radial inner end of the peripheral end wall portion of the rib may be different each other in the radial direction.

With such a constitution, since a position of the radial inner end of the longitudinal lateral wall portion and a position of the radial inner end of the peripheral end wall portions are different in the radial direction, the body is easily shrunk and deformed while narrowing the gap between the longitudinal lateral wall portion and the peripheral end wall portion, and can be reliably provided with the pressure reduction-absorbing performance.

According to a fifth aspect of the present invention, in the fourth aspect, the radial inner end of the peripheral end wall portion may be located at more inside in the radial direction than the radial inner end of the longitudinal lateral wall portion.

With the above constitution, the aforementioned pressure reduction-absorbing performance is remarkably achieved.

According to a sixth aspect of the present invention, in the fourth or fifth aspect, the bottle may have an internal capacity 280 ml or more and 1000 ml or less, and a radial distance between the radial inner end of the longitudinal lateral wall portion and the radial inner end of the peripheral end wall portion of the rib ranges from 1.0 to 2.0 mm.

With the above constitution, the radial distance between the radial inner end of the longitudinal lateral wall portion and the radial inner end of the peripheral end wall portion of the rib is set to 1.0 mm or more. Thereby, the aforementioned pressure reduction-absorbing performance is remarkably achieved. Further, the aforementioned radial distance is set to 2.0 mm or less, and thereby it is possible to suppress deterioration of moldability and a reduction in internal capacity.

According to a seventh aspect of the present invention, in the bottle according to any one of the first to sixth aspects, the rib and the pillar portion may be formed in line symmetry with respect to a central line passing through circumferential centers thereof when viewed in a transverse section in the radial direction.

With the above constitution, the aforementioned pressure reduction-absorbing performance is remarkably achieved.

According to an eighth aspect of the present invention, in the bottle according to the first or second aspect, a top surface which is located at the outside of the rib in the radial direction may be located on a virtual circle when viewed in a transverse section in the radial direction, the virtual circle may connect top parts of the pillar portions which are located at the outside in the radial direction in the circumferential direction.

With the above constitution, since the top surface of the rib is located on the virtual circle extending in the circumferential direction according to the surface shape of each top part of the plurality of pillar portions, the label can be supported on the same surface as the pillar portion at the rib. Thereby, in the label portion covering the panel portions, the displacement of the label portion toward the inside in the radial direction can be reliably regulated.

According to a ninth aspect of the present invention, in the bottle according to the eighth aspect, a width dimension of the top surface of the rib in the circumferential direction may be set to 10% or more and 38.5% or less of a width dimension of the panel portion in the circumferential direction.

A ratio of the width dimension of the top surface of the rib in the circumferential direction to the panel width is set 10% or more and 38.5% or less. Thereby, it is possible to reliably prevent the label mounted on the body from having a poor appearance while being maintained a desired pressure reduction-absorbing performance.

According to a tenth aspect of the present invention, in the bottle according to any one of the first to ninth aspects, the rib is formed throughout a length of the panel bottom wall portion in a direction of a bottle axis, and the rib and the pillar portion of the body have circumferential sizes greater than or equal to a circumferential size of a radial outer end opening part of the gap.

With the above constitution, since the circumferential sizes of the rib and the pillar portion are greater than or equal to the circumferential size of the gap located between the rib and the longitudinal lateral wall portion in the radial outer end opening part, the label wrapped around the body can be supported by the body from the inside in the radial direction by the ribs and the pillar portions. For this reason, it is possible to regulate the label covering the body from moving to the inside in the radial direction when the label is mounted, and it is possible to maintain the label smooth. Thereby, it is possible to prevent the label from being pulled into the gaps and crimping, and to prevent the sense of discomfort from occurring with the appearance of the label.

Especially, with the above constitution, since the rib is formed throughout the length of the panel bottom wall portion in the direction of the bottle axis, the label can be supported by the rib throughout the direction of the bottle axis at the portion overlapping the rib when viewed in the radial direction. Thereby, it is possible to reliably prevent the crimps from being generated in the label.

Furthermore, since the supporting area of the label can be secured on the body by the ribs and the pillar portions, it is possible to reliably prevent the sense of discomfort from occurring with the appearance of the label.

According to an eleventh aspect of the present invention, in any one of the first to tenth aspects, the bottle may further include a bottom portion continuous with a lower end of the body and configured to close a lower end opening part of the body. A bottom wall portion of the bottom portion may include a grounding portion located at an outer circumferential edge, a standing peripheral wall portion continuous with the grounding portion from the inside in the radial direction and configured to extend upward, a movable wall portion which has an annlar shape and is configured to protrude from an upper end of the standing peripheral wall portion toward the radial inner side, and a recessed circumferential wall portion configured to extend upward from a radial inner end of the movable wall portion. The movable wall portion may be arranged to be rotatable around a portion connected to the standing peripheral wall portion so as to cause the recessed circumferential wall portion to move in an upward/downward direction.

According to the above aspect, the movable wall portion is arranged to be rotatable around the portion connected to the standing peripheral wall portion so as to cause the recessed circumferential wall portion to move vertically. For this reason, when the internal pressure of the bottle is changed, the movable wall portion is rotated to absorb a change in the internal pressure. Thereby, it is possible to suppress bottle radial deformation of the shoulder portion and the body. Accordingly, it is possible to reliably prevent the label from having a poor appearance.

Effects of Invention

In the bottle according to the present invention, the body can be provided with the pressure reduction-absorbing performance while preventing the sense of discomfort from occurring with the appearance of the label.

DESCRIPTION OF EMBODIMENTS

First Embodiment

Figure 1:
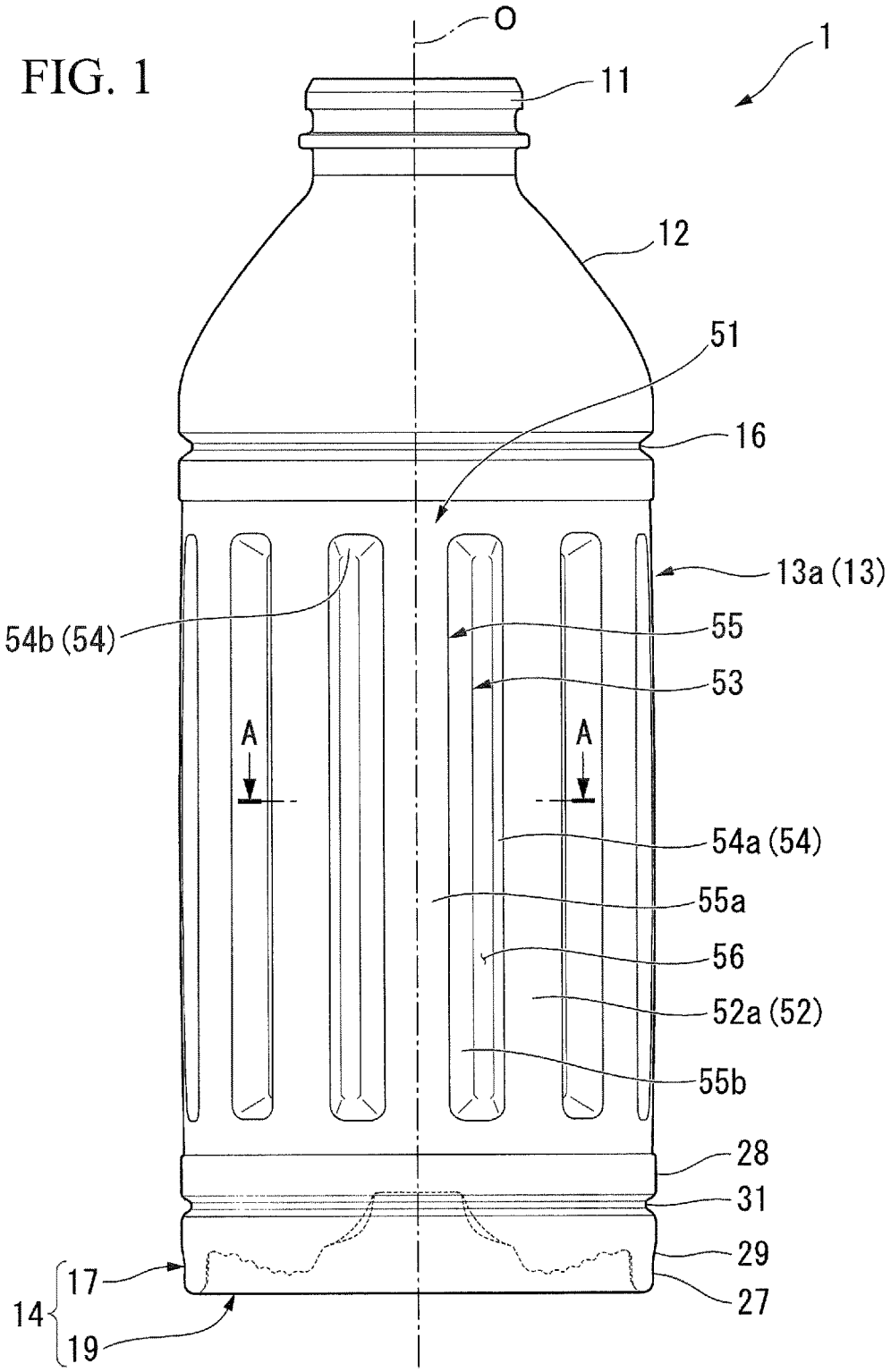
FIG. 1 is a side view of a bottle according to a first embodiment of the present invention.

Hereinafter, a bottle according to a first embodiment of the present invention will be described with reference to the drawings. As shown in FIGS. 1 to 4, the bottle 1 according to the present embodiment includes a mouth portion 11, a shoulder portion 12, a body 13, and a bottom portion 14. The bottle 1 according to the present embodiment has a schematic constitution in which the mouth portion 11, the shoulder portion 12, the body 13, and the bottom portion 14 have central axes placed on a common axis, and are provided continuously in this order.

Hereinafter, the aforementioned common axis is referred to as a bottle axis O. In a direction of the bottle axis O, an area positioned near the mouth portion 11 is referred to as an upside, and an area positioned near the bottom portion 14 is referred to as a downside. A direction perpendicular to the bottle axis O is referred to as a radial direction, and a direction revolving around the bottle axis O is referred to as a circumferential direction.

The bottle 1 according to the present embodiment is integrally formed of a synthetic resin material and is formed by blow-molding a preform formed in a bottomed cylindrical shape by injection molding. Further, the mouth portion 11 is mounted with a cap (not shown). Furthermore, each of the mouth portion 11, the shoulder portion 12, the body 13, and the bottom portion 14 has an approximately circular shape when viewed in a transverse section running in the radial direction. An internal capacity of the bottle 1 according to the present embodiment is between 280 and 1000 ml.

A first annular recessed groove 16 is continuously formed throughout the circumference of a connecting portion between the shoulder portion 12 and the body 13.

The body 13 is formed in a cylindrical shape. The body 13 is continuous with a lower end of the shoulder portion 12, and extends downward. An intermediate part 13*a* between both ends of the body 13 in the direction of the bottle axis O has a smaller diameter than both ends of the body 13. The intermediate part 13*a* of the body 13 is configured for a label such as a shrink label (not shown) to be wrapped therearound.

Figure 3:
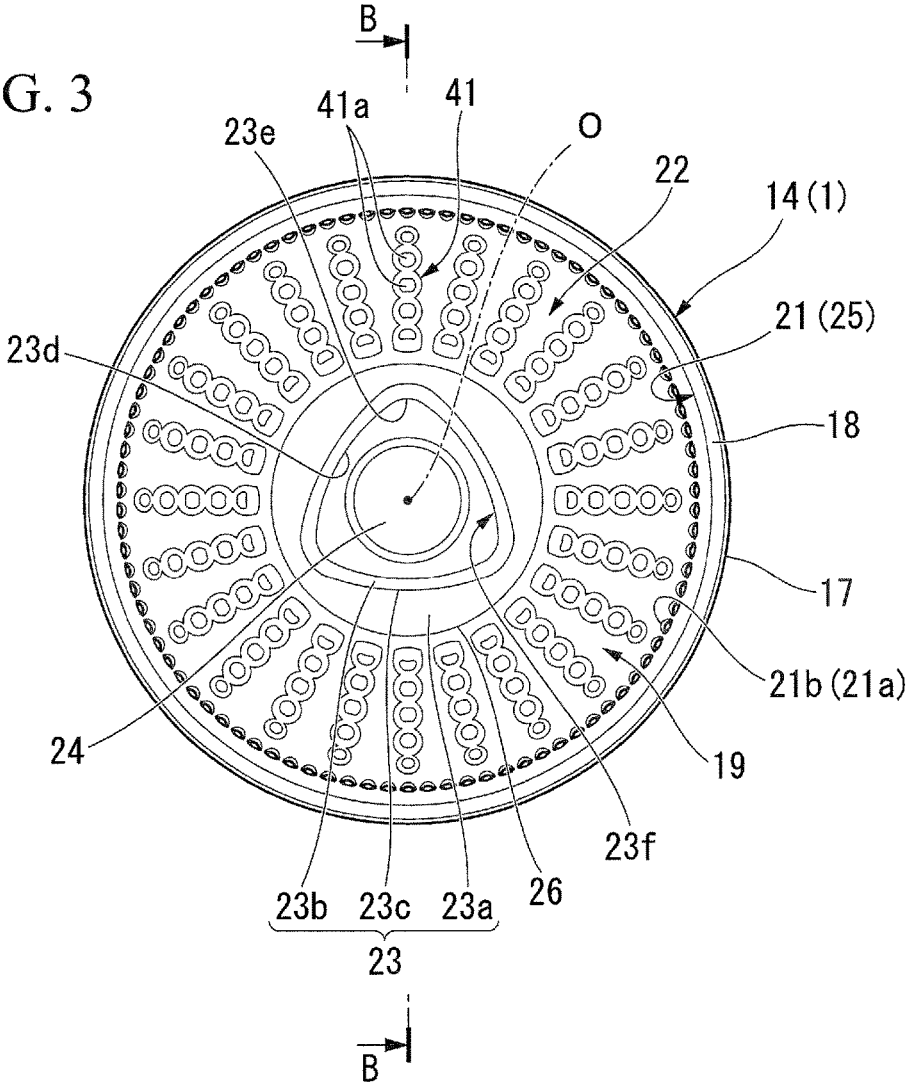
FIG. 3 is a bottom view of the bottle according to the first embodiment of the present invention.
Figure 4:
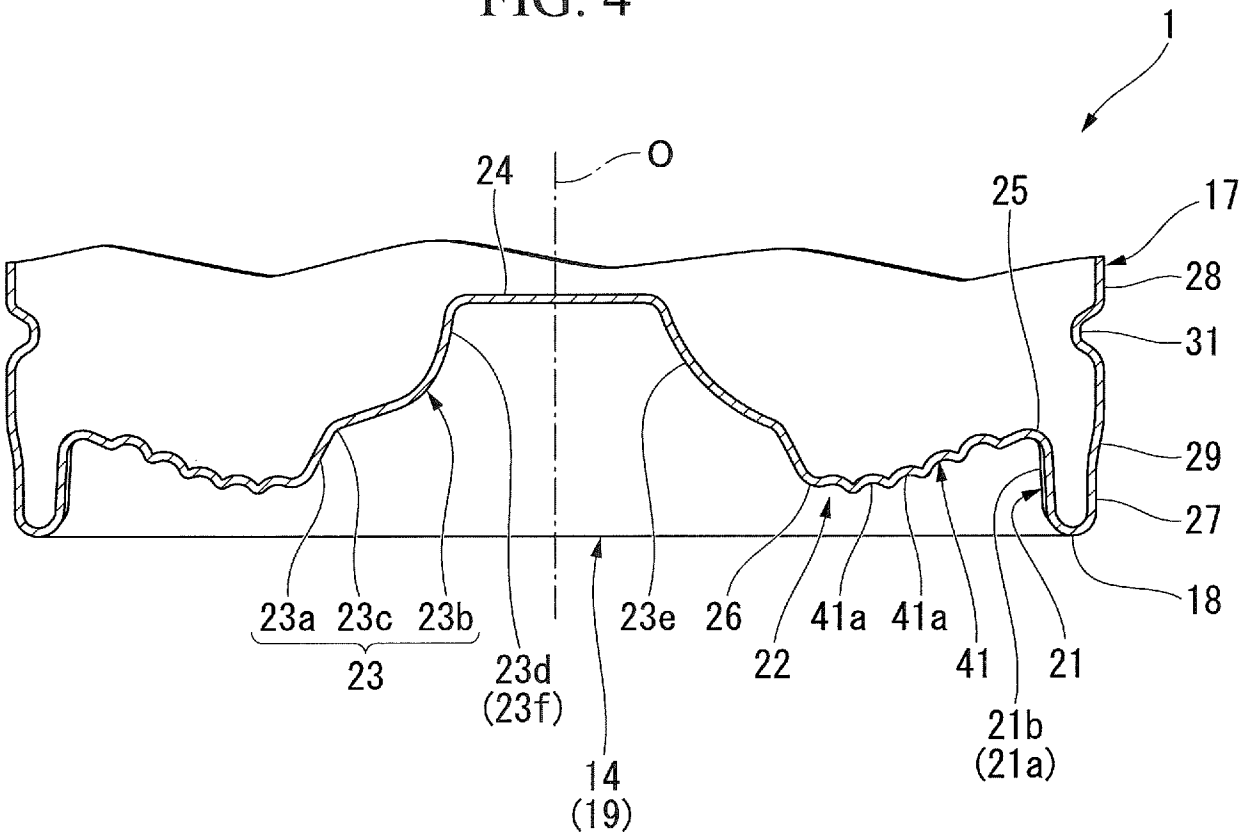
FIG. 4 is a cross-sectional view taken along line B-B of FIG. 3.

As shown in FIGS. 1, 3 and 4, the bottom portion 14 is formed in a bottomed cylindrical shape, and includes a heel portion 17 and a bottom wall portion 19. An upper end opening part of the heel portion 17 is connected to a lower end opening part of the body 13. The bottom wall portion 19 closes a lower end opening part of the heel portion 17, and an outer circumferential edge thereof constitutes a grounding portion 18.

The heel portion 17 includes a lower heel portion 27, an upper heel portion 28, and a connection portion 29. The lower heel portion 27 is continuous with the grounding portion 18 from an outside in a radial direction, and the upper heel portion 28 is continuous with the body 13 from below. The connection portion 29 connects the lower heel portion 27 and the upper heel portion 28.

The lower heel portion 27 is formed with a diameter smaller than that of the upper heel portion 28. The connection portion 29 has a constitution in which a diameter thereof is gradually reduced from top to bottom.

The upper heel portion 28 is a maximum outer diameter part at which an outer diameter of the bottle 1 is largest together with both ends of the body 13 in the direction of the bottle axis O. Further, an intermediate portion of the upper heel portion 28 in the direction of the bottle axis O has a second annular recessed groove 31 that is continuously formed throughout the circumference.

As shown in FIGS. 3 and 4, the bottom wall portion 19 includes a standing peripheral wall portion 21, a movable wall portion 22 which has an annular shape, and a recessed circumferential wall portion 23. The standing peripheral wall portion 21 is continuous with the grounding portion 18 from an inside in a radial direction and extends upward. The movable wall portion 22 protrudes from an upper end of the standing peripheral wall portion 21 toward the inside in the radial direction. The recessed circumferential wall portion 23 extends upward from a radial inner end of the movable wall portion 22.

The standing peripheral wall portion 21 is gradually reduced in diameter from bottom to top. The standing peripheral wall portion 21 has an uneven portion 21*a* formed throughout the circumference. The uneven portion 21*a* has a constitution in which a plurality of protrusions 21*b* formed in a shape of a curved surface protruding toward the inside in the radial direction are arranged at intervals in the circumferential direction.

The movable wall portion 22 is formed in a shape of a curved surface protruding downward, and gradually extends downward from the outside in the radial direction toward the inside in the radial direction. The movable wall portion 22 and the standing peripheral wall portion 21 are connected via a curved surface portion 25 protruding upward. Then, the movable wall portion 22 is configured to be rotatable around the curved surface portion 25, i.e., a portion connected to the standing peripheral wall portion 21, so as to cause the recessed circumferential wall portion 23 to move upward.

Further, the movable wall portion 22 has a plurality of ribs 41 radially arranged around the bottle axis O. Each rib 41 has a constitution in which a plurality of recesses 41*a* recessed upward in a curved surface shape are intermittently arranged in the radial direction.

The recessed circumferential wall portion 23 is arranged on the same axis as the bottle axis O. A top wall 24 disposed on the same axis as the bottle axis O is connected to an upper end of the recessed circumferential wall portion 23. A whole of the recessed circumferential wall portion 23 and the top wall 24 is formed in a cylindrical shape having a top.

The recessed circumferential wall portion 23 is formed in a multistep cylindrical shape in which a diameter thereof is gradually increased from upward to downward. To be specific, the recessed circumferential wall portion 23 includes a lower tube part 23*a*, an upper tube part 23*b*, and an annular step part 23*c*. The lower tube part 23*a* is formed in such a manner that a diameter thereof is gradually reduced upward from a radial inner end of the movable wall portion 22. The upper tube part 23*b* is gradually increased in diameter downward from an outer circumferential edge of the top wall 24, and has a smaller diameter than the lower tube part 23*a*. The annular step part 23*c* interconnects both the tube parts 23*a* and 23*b*.

As shown in FIGS. 3 and 4, the lower tube part 23*a* is connected to the radial inner end of the movable wall portion 22 via a curved surface portion 26 protruding downward. The curved surface portion 26 protrudes in a direction where an obliquely downward to the inside in the radial direction. The lower tube part 23*a* is formed in a circular shape when viewed in a transverse section running in the radial direction.

The annular step part 23*c* is formed in a shape of a concave curved surface depressed toward the outside in the radial direction. The annular step part 23*c* is located at a height higher than or equal to that of the upper end of the standing peripheral wall portion 21.

A plurality of overhanging parts 23*d* projecting to the inside in the radial direction is formed at the upper tube part 23*b*. The overhanging parts 23*d* are connected in the circumferential direction. Thereby, as shown in FIG. 3, an angular tube part 23*f* is formed in a polygonal-like shape when viewed from the bottom. The angular tube part 23*f* has portions 23*e* located between the overhanging parts 23*d* adjacent to each other in the circumferential direction as angular portions and has the overhanging parts 23*d* as sides.

The overhanging parts 23*d* are formed in the shape of a curved surface protruding toward the outside in the radial direction when viewed from the bottom. At the upper tube part 23*b* of the recessed circumferential wall portion 23, the plurality of overhanging parts 23*d* are disposed at intervals in the circumferential direction. In an example shown in FIG. 3, three overhanging parts 23*d* are formed, and a shape of the angular tube part 23*f* when viewed from the bottom is an equilateral triangle shape. The overhanging parts 23*d* are formed in the shape of a curved surface protruding toward the inside in the radial direction in a longitudinal section along the direction of the bottle axis O shown in FIG. 4.

The portion 23*e* between the overhanging parts 23*d* is formed in a shape of a curved surface protruding toward the outside in the radial direction when viewed from the bottom. The portion 23*e* connects ends of the overhanging parts 23*d*, which are adjacent to each other in the circumferential direction, to each other in the circumferential direction.

Figure 2:
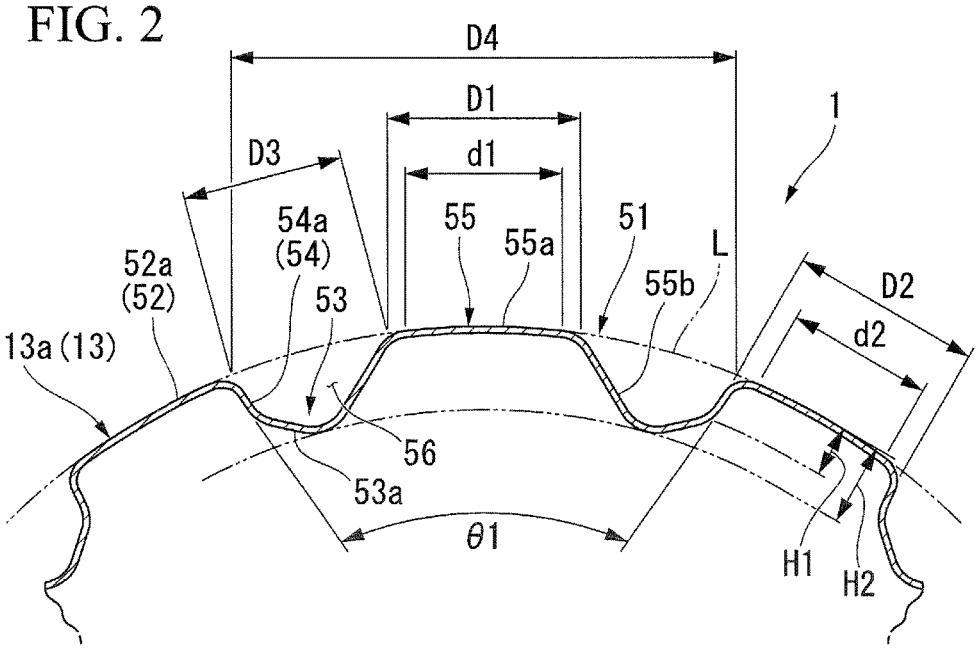
FIG. 2 is a cross-sectional view taken along line A-A of FIG. 1.

Here, as shown in FIGS. 1 and 2, a plurality of panel portions 51 for absorbing pressure reduction, which are recessed toward the inside in the radial direction, are formed on the intermediate part 13*a* of the aforementioned body 13. The panel portions 51 are formed at intervals in the circumferential direction. In the present embodiment, six panel portions 51 are formed at regular intervals. Portions of the body 13, each of which is located between the panel portions 51 adjacent to each other in the circumferential direction, constitute pillar portions 52 extending in the direction of the bottle axis O. In other words, the panel portions 51 and the pillar portions 52 are mutually arranged on the body 13 in the circumferential direction. The panel portions 51 extend in the direction of the bottle axis O at a portion that bypasses both ends of the intermediate part 13*a* of the body 13 in the direction of the bottle axis O.

The panel portions 51 are each defined by a panel bottom wall portion 53 located at the inside in the radial direction with respect to an outer circumferential surface of the body 13, and a lateral wall portion 54 extending from an outer circumferential edge of the panel bottom wall portion 53 toward the outside in the radial direction.

The lateral wall portion 54 has a pair of longitudinal lateral wall portions 54*a*. The pair of longitudinal lateral wall portions 54*a* is continuous with both ends of the panel bottom wall portion 53 in the circumferential direction and extends in the direction of the bottle axis O. The longitudinal lateral wall portions 54*a* of the lateral wall portion 54 are inclined toward an outside in the circumferential direction, i.e., in a direction in which the pair of longitudinal lateral wall portions 54*a* constituting one panel portion 51 are spaced apart from each other, from the inside to the outside in the radial direction. Alternatively, the longitudinal lateral wall portions 54*a* may be configured to extend in the radial direction without inclination. The pillar portions 52 are each located between the longitudinal lateral wall portions 54*a* of the panel portions 51 adjacent to each other in the circumferential direction. The pillar portions 52 are formed such that a shape viewed in a transverse section perpendicular to the bottle axis O is a rectangular shape or a trapezoidal shape. A top part 52*a* is located at an outside in the radial direction of the pillar portions 52. The top part 52*a* is formed in a shape of a curved surface protruding toward the outside in the radial direction. The top part 52*a* is an outermost diameter part at which an outer diameter of the intermediate part 13*a* is largest in the body 13.

The lateral wall portion 54 is provided with a pair of transverse lateral wall portions 54*b* that are located at both ends in the direction of the bottle axis O and extend in the circumferential direction. The pair of transverse lateral wall portions 54*b* of the lateral wall portion 54 have inclined surfaces gradually inclined toward the outside thereof in the direction of the bottle axis O in accordance with a position from the inside to the outside in the radial direction.

A rib 55 protruding toward the outside in the radial direction is formed at a circumferential middle part of the panel bottom wall portion 53. The rib 55 is arranged between the longitudinal lateral wall portions 54*a* constituting the same panel portion 51. The rib 55 is arranged so as to have a gap 56 with respect to the longitudinal lateral wall portions 54*a* in the circumferential direction. In addition, the rib 55 is formed throughout a length of the panel bottom wall portion 53 in the direction of the bottle axis O. Accordingly, the panel portion 51 of the present embodiment is configured such that a pair of transverse lateral wall portions 54*b* facing each other in the direction of the bottle axis O are bridged at a circumferential middle part of the panel 51 by the rib 55, and both sides thereof in the circumferential direction with respect to the rib 55 constitute a pair of gaps 56 extending in the direction of the bottle axis O. In this case, two gaps 56 are located between circumferential outer ends of the panel portion 51 and circumferential outer ends of the rib 55, and are arranged on each panel portion 51. For this reason, in the present embodiment, a total of 12 gaps 56 are arranged at intervals in the circumferential direction.

The rib 55 is defined by a top wall portion 55*a* located at the outside in the radial direction with respect to the panel bottom wall portion 53 and peripheral end wall portions 55*b* connecting circumferential outer ends of the top wall portion 55*a* and the panel bottom wall portion 53.

The top wall portion 55*a* is formed in a shape of a curved surface protruding to the outside in the radial direction when viewed in a transverse section in the radial direction (see FIG. 2). The top wall portion 55*a* is substantially located on a virtual circle L extending in the circumferential direction according to a surface shape of each top part 52*a* at the plurality of pillar portions 52. The top wall portion 55*a* is an outermost diameter part of the intermediate part 13*a* in the body 13.

Here, as shown in FIG. 2, a width dimension D1 of the rib (hereinafter referred to as a "rib width D1") in a direction along a tangential direction of the intermediate part 13*a* at the top wall portion 55*a* has a width greater than or equal to a width dimension D2 of the pillar (hereinafter referred to as a "pillar width D2") in a direction along a tangential direction of the top part 52*a* at the pillar portion 52. The rib width D1 and the pillar width D2 are greater than or equal to a width dimension D3 of an opening of the gap 56 (hereinafter referred to as an "opening width D3") at a position along a tangential direction at a radial outer end opening part. In the shown example, the rib width D1 is greater than the pillar width D2, and the rib width D1 and the pillar width D2 are greater than the opening width D3 (i.e., D1>D2>D3).

The peripheral end wall portions 55*b* are located at both ends of the rib 55 in the circumferential direction, extend in the direction of the bottle axis O, and are inclined toward circumferential outer sides from the outside in the radial direction toward the inside in the radial direction. Accordingly, the rib 55 is formed in a trapezoidal shape in which a circumferential width thereof is gradually increased from the outside in the radial direction to the inside in the radial direction when viewed in a transverse section along the radial direction.

In the present embodiment, a position of a radial inner end of the longitudinal lateral wall portion 54*a* and a position of a radial inner end of the peripheral end wall portion 55*b* are different in the radial direction. To be specific, in examples shown in FIGS. 2 and 5 to 10, a radial length (depth) H1 of the longitudinal lateral wall portion 54*a* is shorter than a radial length (depth) H2 of the peripheral end wall portion 55*b* (H1<H2).

The pillar portion 52 and the rib 55 of the present embodiment are each formed to be line symmetric with respect to the central line extending through the circumferential center in the radial direction. In other words, the pair of peripheral end wall portions 55*b* constituting the same rib 55 are formed such that positions of radial inner ends in the radial direction are equal to each other. The pair of longitudinal lateral wall portions 54*a* constituting the same pillar portion 52 are formed such that positions of radial inner ends in the radial direction are equal to each other. Accordingly, in the same panel portion 51, the longitudinal lateral wall portion 54*a* and the peripheral end wall portion 55*b* face each other in the circumferential direction, and a length of the longitudinal lateral wall portion 54*a* is shorter than the peripheral end wall portion 55*b* in the radial direction. A distance along the radial direction between the radial inner end of the longitudinal lateral wall portion 54*a* and the radial inner end of the peripheral end wall portion 55*b* (i.e., a difference between the depth H1 of the longitudinal lateral wall portion 54*a* and the depth H2 of the peripheral end wall portion 55*b*) is set to a range from 1.0 to 2.0 mm.

A connecting portion 53*a* connects the radial inner end of the longitudinal lateral wall portion 54*a* of the panel bottom wall portion 53 and the radial inner end of the peripheral end wall portion 55*b*. To be specific, the connecting portion 53*a* is inclined toward the inside of the circumferential direction from the outside of the radial direction toward the inside of the radial direction when viewed in a transverse section running in the radial direction. The aforementioned gap 56 is defined by the longitudinal lateral wall portion 54*a*, the transverse lateral wall portion 54*b*, the connecting portion 53*a*, and the peripheral end wall portion 55*b*.

Accordingly, in the present embodiment, when a pressure in the bottle 1 is reduced, the body 13 is preferentially easily deformed by a reduction in diameter while narrowing the gaps 56 between the pillar portions 52 and the ribs 55 in the circumferential direction. As a result, the body 13 can be provided with pressure reduction-absorbing performance. Furthermore, since at least eight gaps 56 (12 gaps in the present embodiment) are formed in the body 13, it is possible to prevent the body 13 from being incorrectly deformed and generating angular portions when the pressure of the bottle 1 is reduced. As a result, it is possible to reliably maintain a good appearance of the label.

Moreover, since the radial inner end of the longitudinal lateral wall portion 54*a* and the radial inner end of the peripheral end wall portion 55*b* are different in a position in the radial direction, the gaps 56 are easily deformed, and the pressure reduction-absorbing performance can be reliably provided.

Thereby, it is possible to absorb a change in internal pressure (a reduction in pressure) of the bottle 1 while suppressing deformation at regions other than the gaps 56 (e.g., the pillar portions 52, the ribs 55, and the shoulder portion 12).

Here, in the present embodiment, the rib 55 is arranged at the panel bottom wall portion 53, and the rib width D1 of the rib 55 and the pillar width D2 of the pillar portion 52 are greater than or equal to the opening width D3 of the gap 56. For this reason, the label wrapped around the body 13 can be supported from the inside of the radial direction by the ribs 55 and the pillar portions 52. As such, when the label is mounted, the label covering the body 13 is restricted from moving to the inside of the radial direction and it is possible to smoothly maintain the label. Thereby, it is possible to prevent the label from being pulled into the gaps 56 and generating crimps, and to prevent a sense of discomfort from occurring with the appearance of the label.

Moreover, the rib 55 is formed throughout the length of the panel bottom wall portion 53 in the direction of the bottle axis O. For this reason, the label can be supported in the direction of the bottle axis O throughout a portion overlapping the rib 55 when viewed in the radial direction. Thereby, it is possible to reliably prevent crimps from being generated in the label.

Furthermore, since a supporting area of the label can be secured on the body 13 by the ribs 55 and the pillar portions 52, it is possible to reliably prevent the sense of discomfort from occurring with the appearance of the label.

Accordingly, even when the gaps 56 are deformed during the reduction in pressure, the body 13 maintains a circular shape, and thus incorrect displacement of the label is suppressed. For this reason, it is possible to provide the body 13 with the pressure reduction-absorbing performance while preventing the sense of discomfort from occurring with the appearance of the label.

In the present embodiment, the movable wall portion 22 is arranged to be rotatable around the curved surface portion 25 so as to cause the recessed circumferential wall portion 23 to move in the direction of the bottle axis O. For this reason, when the internal pressure of the bottle 1 is changed, the movable wall portion 22 is rotated to absorb a change in the internal pressure. Thereby, it is possible to suppress radial deformation of the shoulder portion 12 and the body 13. For this reason, it is possible to reliably prevent the label from having a poor appearance.

When the pressure reduction-absorbing performance caused by the movable wall portion 22 is sufficient, it can also be configured to preferentially displace the movable wall portion 22 in a pressure reduction state in the bottle 1, and to suppress (prevent) deformation of the gaps 56. In this case, it is possible to form, for instance, the rib width D1 as great as possible, and to more reliably prevent the label from having a poor appearance.

Here, it was verified how an absorption capacity (ml) for pressure reduction intensity (kPa) is changed according to a shape of the body 13. The bottle 1 used for the present verification was a bottle having an internal capacity of 500 ml. Further, in the present verification, the bottom wall portion 19 was configured to be safe from substantial deformation during the reduction in pressure, and an absorption capacity of the body 13 alone was verified by analysis.

Next, a sample bottle used for the present verification will be described.

Figure 9:
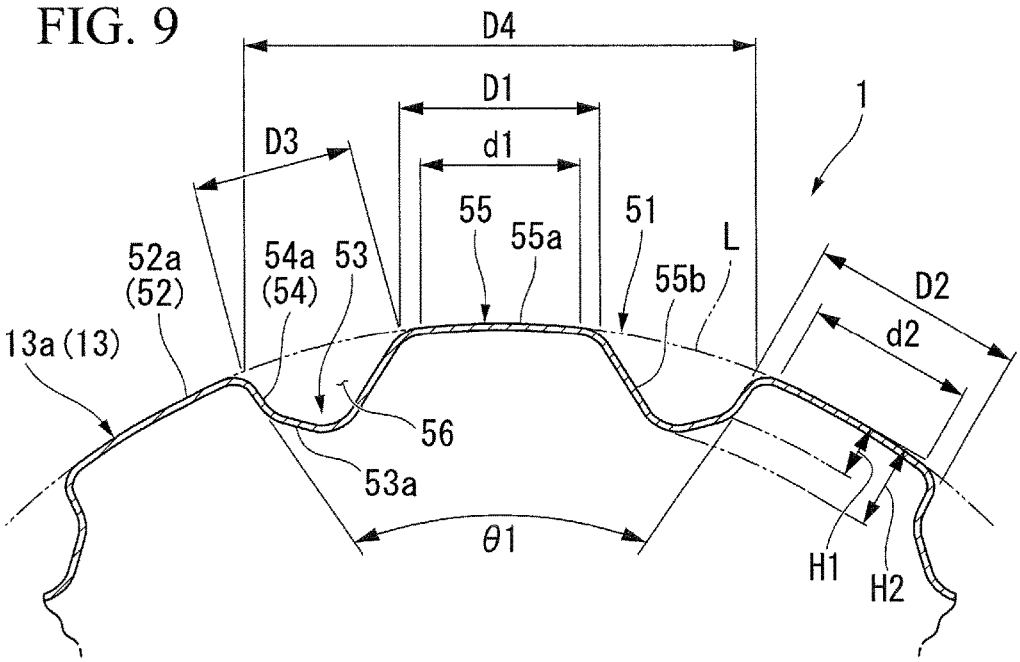
FIG. 9 is a partial cross-sectional view of a portion corresponding to FIG. 2 in Sample 6.
Figure 10:
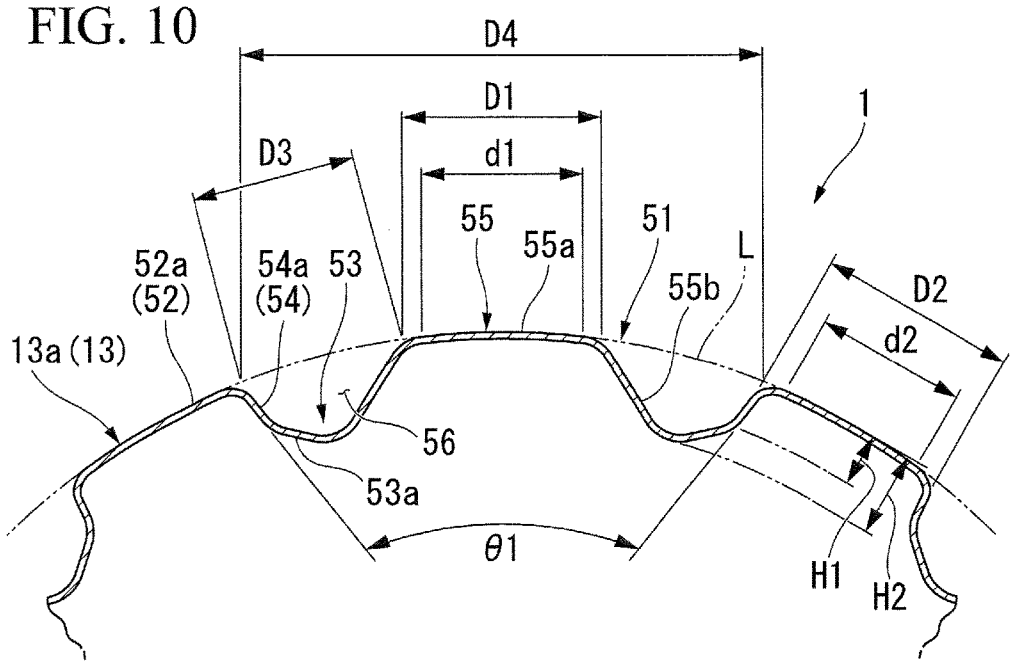
FIG. 10 is a partial cross-sectional view of a portion corresponding to FIG. 2 in Sample 9.
Figure 11:
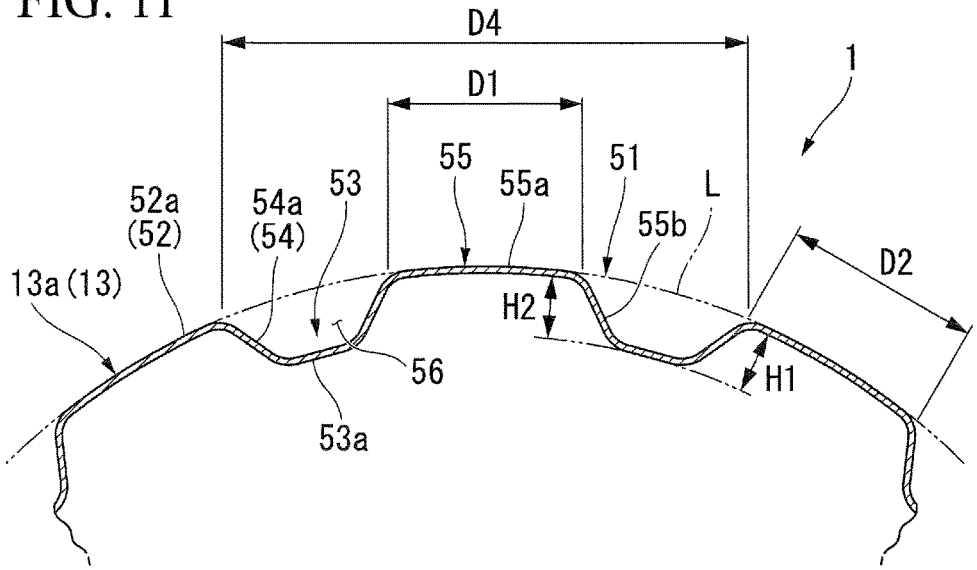
FIG. 11 is a partial cross-sectional view of a portion corresponding to FIG. 2 in Sample 8 (Comparative Example).

FIGS. 2 and 5 to 10 show sample bottles (hereinafter referred to as "Samples 1 to 7") of Embodiments 1 to 7, and FIG. 11 shows a sample bottle (hereinafter referred to as "Sample 8") of Comparative Example.

Sample 1 shown in FIG. 2 is a bottle 1 having a constitution similar to that of the present embodiment described above. The following description will use Sample 1 as a basis to describe major differences between Sample 1 and each of Samples 2 to 8.

Figure 5:
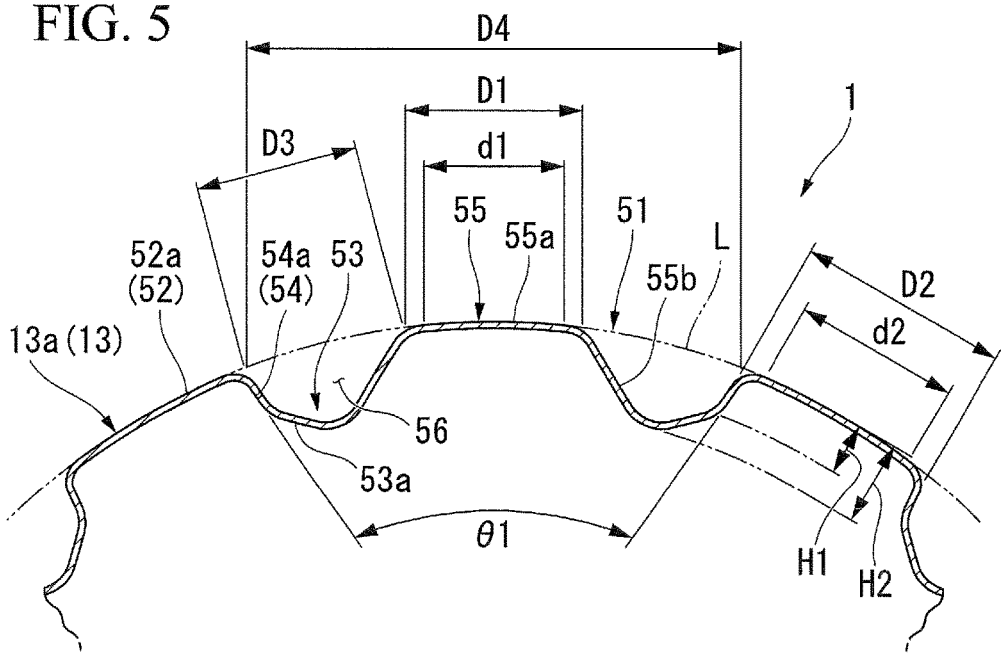
FIG. 5 is a partial cross-sectional view of a portion of Sample corresponding to FIG. 2 in Sample 2.

In Sample 2 shown in FIG. 5, the rib width D1 of the panel portion 51 is smaller than in Sample 1.

Figure 6:
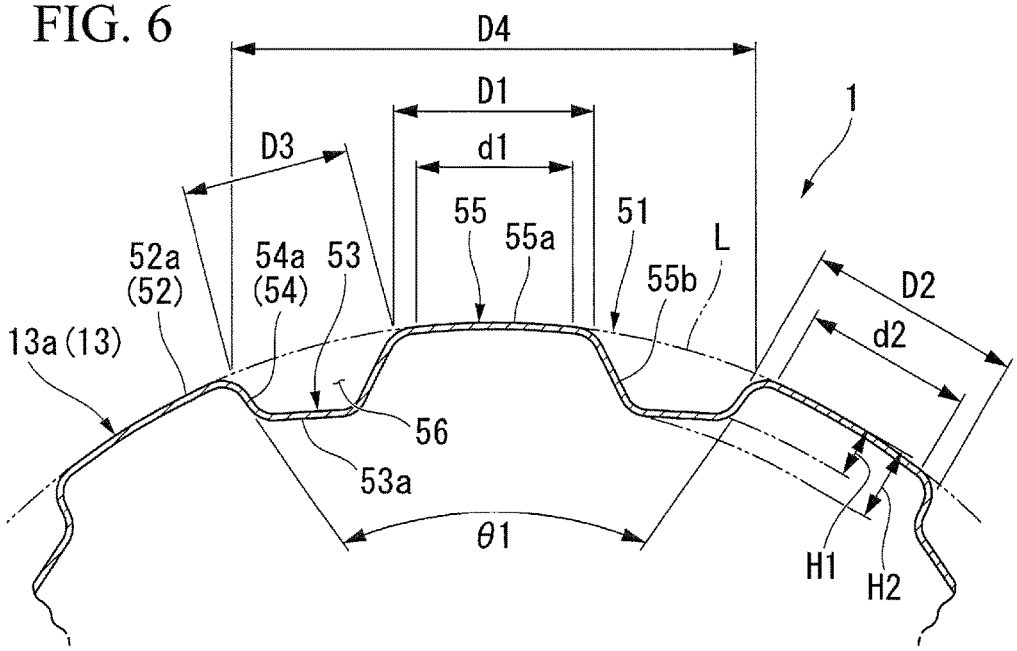
FIG. 6 is a partial cross-sectional view of a portion corresponding to FIG. 2 in Sample 3.

In Sample 3 shown in FIG. 6, the depth H2 of the peripheral end wall portion 55*b* is smaller than in Sample 1, and the difference between the depth H1 of the longitudinal lateral wall portion 54*a* and the depth H2 of the peripheral end wall portion 55*b* is smaller than in Sample 1.

Figure 7:
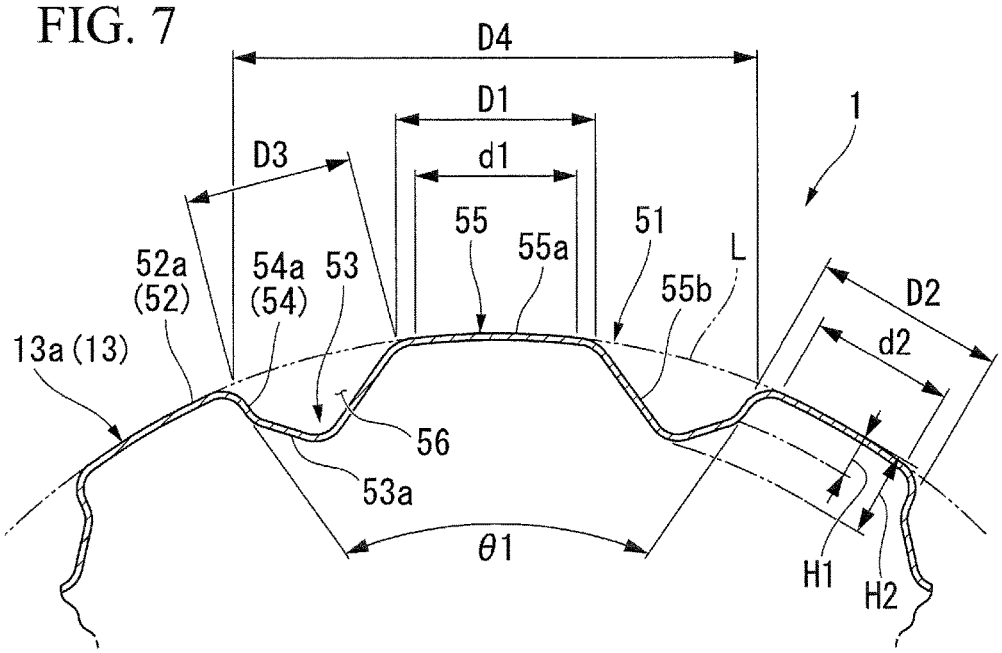
FIG. 7 is a partial cross-sectional view of a portion corresponding to FIG. 2 in Sample 4.

In Sample 4 shown in FIG. 7, the depth H1 of the longitudinal lateral wall portion 54*a* is smaller than in Sample 1, and the difference between the depth H1 of the longitudinal lateral wall portion 54*a* and the depth H2 of the peripheral end wall portion 55*b* is greater than in Sample 1.

Figure 8:
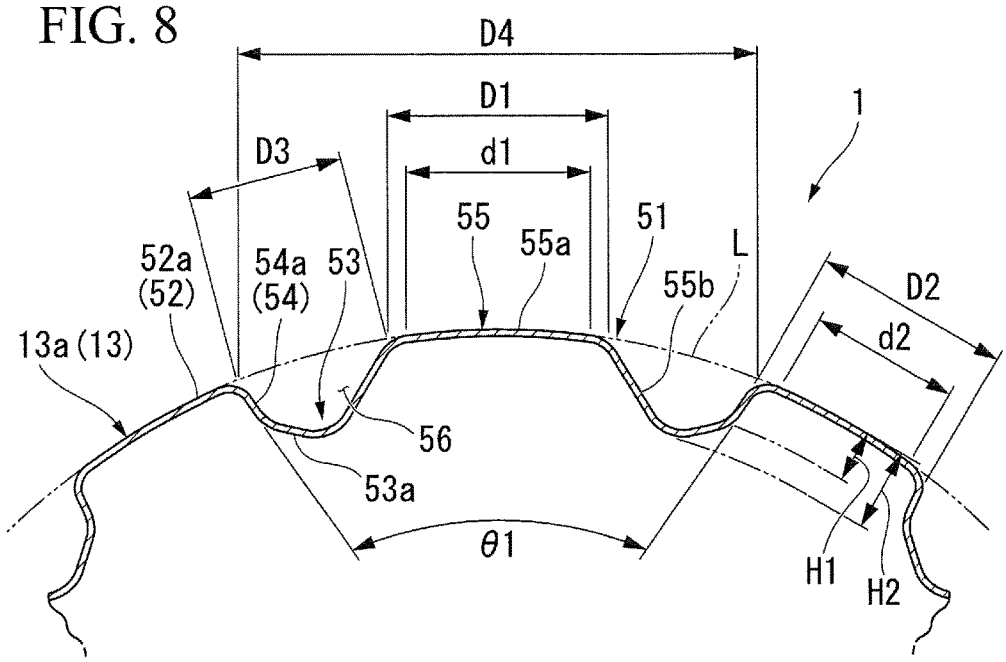
FIG. 8 is a partial cross-sectional view of a portion corresponding to FIG. 2 in Sample 5.

In Sample 5 shown in FIG. 8, the rib width D1 of the panel portion 51 is greater than in Sample 1.

Sample 8 (Comparative Example) shown in FIG. 11 is configured such that the depth H1 of the longitudinal lateral wall portion 54*a* is equal to the depth H2 of the peripheral end wall portion 55*b*.

Specific dimensions of each sample described above are given in Table 1 shown below. Among the aforementioned dimensions, the rib width D1 has a distance in a tangential direction of the intermediate part 13*a* between intersections at which the virtual circle L intersects extension lines of the peripheral end wall portions 55*b* constituting the rib 55 when viewed in a transverse section along in a radial direction. The pillar width D2 has a distance in a tangential direction of the intermediate part 13*a* between intersections at which the virtual circle L intersects extension lines of the longitudinal lateral wall portions 54*a* constituting the pillar portion 52 when viewed in a transverse section running in a radial direction. The opening width D3 is a distance between intersections, one intersection is an intersection between the extension line of the longitudinal lateral wall portion 54*a* and the virtual circle L and the other one is an intersection between the extension line of the peripheral end wall portion 55*b* and the virtual circle L, in a tangential direction of the intermediate part 13*a* when viewed in a transverse section in a radial direction. Furthermore, a symbol D4 of each figure indicates a distance running in a tangential direction of the intermediate part 13*a* between intersections at which the virtual circle L intersects extension lines of the longitudinal lateral wall portions 54*a* at the same panel portion 51 when viewed in a transverse section running in a radial direction, i.e., a width dimension of the panel (hereinafter referred to as a "panel width D4").

On the other hand, the depth H1 is a radial length between the virtual circle L and an intersection between the extension line of the longitudinal lateral wall portion 54*a* and an extension line of the connecting portion 53*a* when viewed in a transverse section running in a radial direction. The depth H2 is a radial length between the virtual circle L and an intersection between the extension line of the peripheral end wall portion 55*b* and the extension line of the connecting portion 53*a* when viewed in a transverse section running in a radial direction.

TABLE 1

| | Sample 1 | Sample 2 | Sample 3 | Sample 4 | Sample 5 | Sample 6 | Sample 7 | Sample 8 |
|---|---|---|---|---|---|---|---|---|
| Depth H1 (mm) | 2.50 | 2.50 | 2.50 | 2.00 | 2.50 | 2.50 | 2.50 | 3.00 |
| Depth H2 (mm) | 4.28 | 4.35 | 3.50 | 4.00 | 4.06 | 4.19 | 4.26 | 3.00 |
| Rib width D1 (mm) | 10.00 | 9.00 | 10.00 | 10.00 | 11.00 | 10.00 | 10.00 | 10.00 |
| Length d1 (mm) | 8.03 | 6.99 | 7.84 | 8.24 | 9.11 | 8.05 | 8.03 | |
| Pillar width D2 (mm) | 9.98 | 11.04 | 9.98 | 9.98 | 9.98 | 10.62 | 9.98 | 10.00 |
| Length d2 (mm) | 7.52 | 8.64 | 7.52 | 7.52 | 7.52 | 8.18 | 7.74 | |
| Opening width D3 (mm) | 8.28 | 8.25 | 8.28 | 8.28 | 7.78 | 7.96 | 8.28 | 8.27 |
| Panel width D4 (mm) | 26.00 | 25.00 | 26.00 | 26.00 | 26.00 | 25.40 | 26.00 | 25.98 |
| Angle θ1 (°) | 70.00 | 70.00 | 70.00 | 70.00 | 70.00 | 70.00 | 80.00 | |

In Sample 6 shown in FIG. 9, the pillar width D2 of the pillar portion 52 is greater than in Sample 1, and the rib width D1 of the panel portion 51 is greater than in Sample 1. In this case, a length d1 of a portion of the rib 55 which is located on the virtual circle L is identical to a length d2 of a portion of the pillar portion 52 which is located on the virtual circle L.

In Sample 7 shown in FIG. 10, an angle θ1 formed by the longitudinal lateral wall portions 54*a* located on both sides of the same panel portion 51 in the circumferential direction is greater than in Sample 1.

Figure 12:
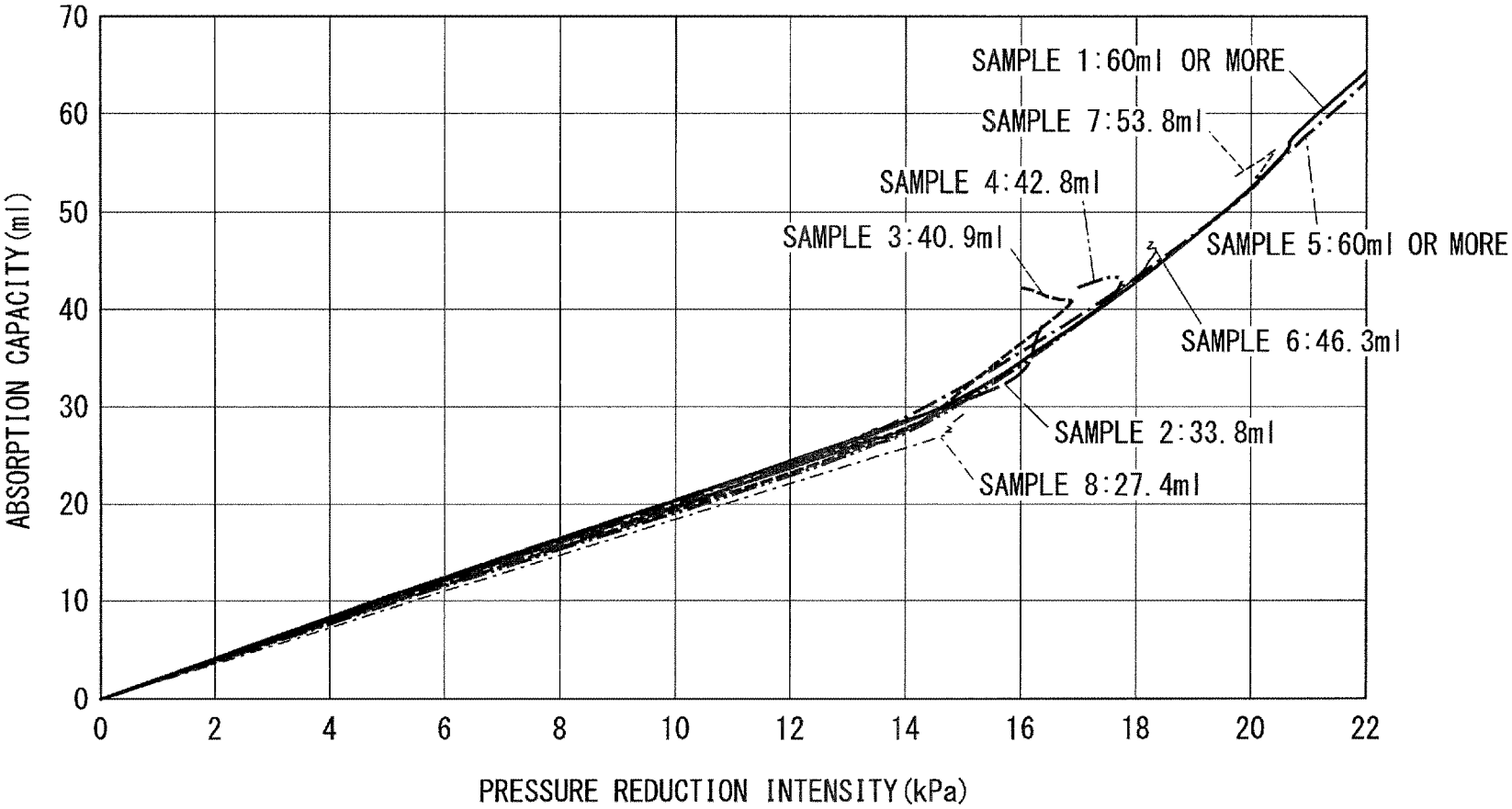
FIG. 12 is a graph showing a relation of an absorption capacity (ml) to pressure reduction intensity (kPa) in Samples 1 to 8.

As shown in FIG. 12, it is found that, as the pressure reduction intensity increases, the absorption capacity of each of Samples 1 to 7 tends to increase. This is thought to be because, as the pressure in the bottle 1 is reduced, the body 13 is preferentially deformed by a reduction in diameter while narrowing the gaps 56 in the circumferential direction, and thereby it is possible to absorb a change in internal pressure (a reduction in pressure) of the bottle 1 while suppressing deformation at regions other than the gaps 56.

Afterwards, when the pressure reduction intensity was increased, any of Samples 1 to 7 could obtain the absorption capacity greater than or equal to 30 ml. In contrast, Sample 8 could not follow an increase in the pressure reduction intensity, and local deformation occurred at places other than the gaps 56 in the course of reducing the pressure (to about 15 kPa). The absorption capacity in each of Samples 1 to 8 was 60 ml or more for Sample 1, 33.8 ml for Sample 2, 40.9 ml for Sample 3, 42.8 ml for Sample 4, 60 ml or more for Sample 5, 46.3 ml for Sample 6, 53.8 ml for Sample 7, and 27.4 ml for Sample 8 (Comparative Example).

Further, comparing Samples 1, 3, 4 and 8, when the depth H1 of the longitudinal lateral wall portions 54 and the depth H2 of the peripheral end wall portions 55*b* were different from each other as in Samples 1, 3 and 4, the absorption capacity increased more than in Sample 8 in which the depth H1 of the longitudinal lateral wall portions 54 and the depth H2 of the peripheral end wall portion 55*b* were equal to each other. However, when a difference between the depth H1 of the longitudinal lateral wall portions 54 and the depth H2 of the peripheral end wall portion 55*b* was too great, this was not favorable because deterioration in moldability and a reduction in internal capacity took place. For this reason, the difference between the depth H1 of the longitudinal lateral wall portions 54 and the depth H2 of the peripheral end wall portion 55*b* is preferably set to a range from 1.0 to 2.0 mm as described above.

Furthermore, in comparison with Samples 1, 2 and 5, when the rib width D1 was greater, the absorption capacity was more increased. In this case, in comparison with Samples 1 and 6, when the rib width D1 was greater than the pillar width D2, the absorption capacity particularly increased.

Further, in comparison with Samples 1 and 7, when the angle θ1 formed between the longitudinal lateral wall portions 54*a* was small, the absorption capacity increased.

Next, how an appearance of a label S wrapped around the body 13 was changed according to the number of ribs 55 and pillar portions 52 was verified by using nine Samples A to I that were different in the total number of ribs 55 and pillar portions 52. In the following description, the rib 55 and the pillar portion 52 are collectively called a convex part 57.

Figure 13:
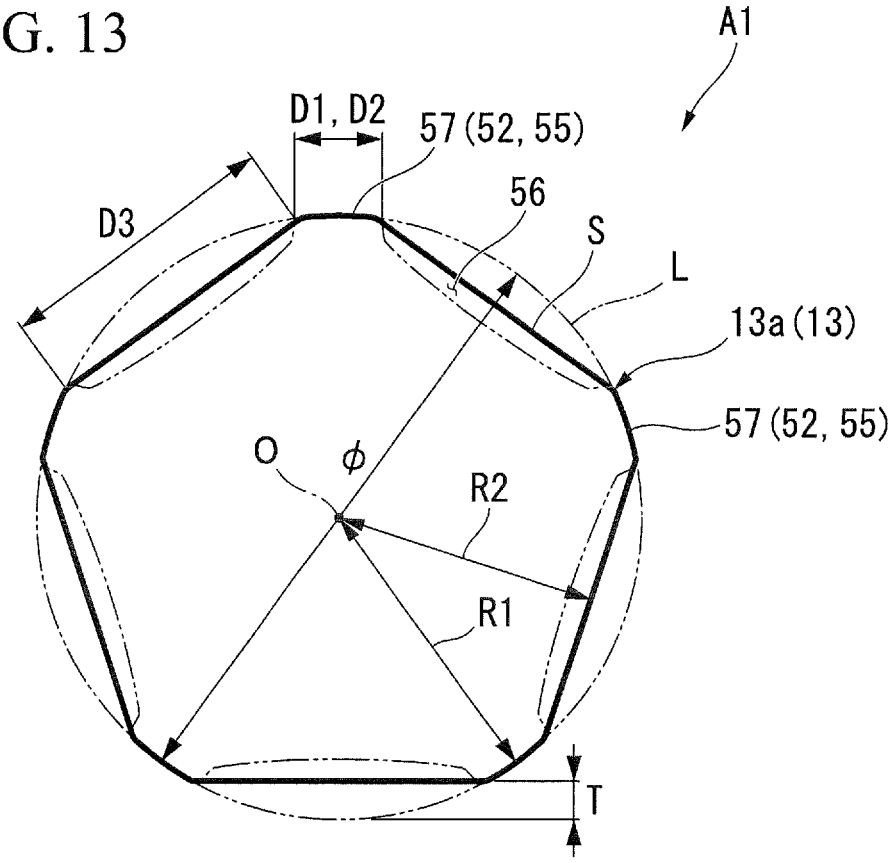
FIG. 13 is a cross-sectional view of the bottle in Sample A.

Table 2 shown below lists specifications (the number of convex parts 57 and a circumferential length of the label S) of Samples A to H and results of determining appearances. Sample I shows that a label S is wrapped around a circular bottle having a body diameter ϕ of 70 mm.

diameter ϕ (an outer diameter of the virtual circle L) is set to 70 mm, a width of the convex part 57 in a circumferential is set to 10 mm (rib width D1=pillar width D2=10 mm), and a gap 56 is provided between the convex parts 57 disposed at regular intervals. Further, the bottle A1 shown in FIG. 13 is formed with five convex parts 57 altogether. A label S is wrapped throughout the circumference of the body 13 so as to cover the convex parts 57 and the gaps 56.

Samples B to H have the body diameter ϕ and the convex-part width (the rib width D1 and the pillar width D2) same as Sample A, and the numbers of convex parts 57 are configured to increase one by one.

Further, a label height difference T, a visible label circumferential length, and a visible label width shown in Table 2 are defined as follows.

(1) Label Height Difference T

It is a difference between a length R1 and a length R2. The length R1 (corresponding to radii of the virtual circle L and the body diameter ϕ) is a length from a portion of the label S which covers the convex part 57 to the bottle axis O in the radial direction. The length R2 is a length from a portion of the label S which covers the gap 56 to the bottle axis O in the radial direction.

(2) Visible Label Circumferential Length

It is a circumferential length of the visually recognizable label S at each of different points of view in the body 13 in the circumferential direction.

(3) Visible Label Width

It is a width when the label S of a visually recognizable range is projected in the radial direction at each of different points of view in the body 13 in the circumferential direction.

As shown in Table 2, it is found that, as the number of convex parts 57 increases, the label height difference T decreases. This is thought to be because the opening width D3 of the gap 56 can be reduced by increasing the number of convex parts 57, and the circumferential length of the portion of the label S which covers the gap 56 can be reduced by securing the supporting area of the label S based on the convex parts 57.

Especially in the case of Samples C to H (having seven or more convex parts 57), it is possible to suppress the label height difference T to 2.00 mm or less, and maintain the

TABLE 2

| | | Sample A | Sample B | Sample C | Sample D | Sample E | Sample F | Sample G | Sample H | Sample I |
|---|---|---|---|---|---|---|---|---|---|---|
| Number of convex parts | | 5 | 6 | 7 | 8 | 9 | 10 | 11 | 12 | 0 |
| Label circumference | | 212.15 | 215.14 | 216.84 | 217.86 | 218.51 | 218.94 | 219.23 | 219.43 | 219.91 |
| Label height difference T | | 4.43 | 2.85 | 1.93 | 1.35 | 0.97 | 0.71 | 0.53 | 0.40 | — |
| Maximum | Visible label width (projection) | 68.58 | 70.00 | 69.55 | 70.00 | 69.85 | 70.00 | 69.96 | 70.00 | 70.00 |
| | Visible label circumference | 119.11 | 107.57 | 116.00 | 108.93 | 113.63 | 109.47 | 111.91 | 109.71 | 109.96 |
| Minimum | Visible label width (projection) | 65.57 | 64.30 | 68.07 | 67.30 | 69.03 | 68.58 | 69.47 | 69.20 | 70.00 |
| | Visible label circumference | 89.42 | 81.15 | 97.22 | 90.11 | 101.26 | 95.75 | 103.69 | 99.45 | 109.96 |
| Visible label circumference difference (maximum − minimum) | | 29.69 | 26.43 | 18.78 | 18.82 | 12.38 | 13.72 | 8.22 | 10.26 | |
| Visible label circumference difference/ visible label circumference of Sample I | | 13.50% | 12.02% | 8.54% | 8.56% | 5.63% | 6.24% | 3.74% | 4.67% | |
| Label height difference T/body diameter ϕ | | 6.33% | 4.07% | 2.76% | 1.93% | 1.39% | 1.01% | 0.76% | 0.57% | |

First, Samples A to H used for the present verification will be described taking Sample A shown in FIG. 13 as an example.

As shown in FIG. 13, the bottle A1 of Sample A used for the present verification is configured such that a body appearance of the label S well without causing a sense of discomfort. In this case, the label height difference T for the body diameter is suppressed to 3.0% or less (preferably 2.0% or less), and thereby the appearance can be maintained well regardless of a magnitude of the body diameter ϕ.

A visible label circumferential length difference (a difference between a maximum value and a minimum value of the visible label circumferential length) also shows a tendency to reduce when the number of convex parts 57 is increased. In other words, as the number of convex parts 57 increases, the shape of the body 13 when viewed in a transverse section approaches a circular shape (virtual circle L). As the result, it is possible to prevent the circumferential length of the visually recognizable label S from differing at each point of view in the circumferential direction.

Especially in the case of Samples C to H, i.e., the seven or more convex parts 57, it is possible to suppress the visible label circumferential length difference to 20.00 mm or less, and maintain the appearance of the label S well without causing a sense of discomfort. In this case, the visible label circumferential length difference is suppressed to 10.0% or less relative to the label circumferential length (entire length) of Sample I, and thereby the appearance can be maintained well regardless of the label circumferential length of the circular bottle.

Since moldability tends to deteriorate when the number of convex parts 57 is more than or equal to 17, the number of convex parts 57 is preferably set to 16 or less.

The number of convex parts 57 is preferably set to an even number so that stress is distributed evenly. In this case, the ribs 55 and the pillar portions 52 are more preferably set to an even number.

While a preferred embodiment of the present invention has been described in detail with reference to the drawings, a specific constitution is not limited to the embodiments, and a change in design is also included without departing from the spirit and scope of the present invention.

For example, if the number or arrangement of gaps 56 is more than or equal to eight (if the number of panel portions 51 is more than or equal to four), an appropriate change in design is possible in consideration of the strength and pressure reduction-absorbing capacity required for the bottle 1.

In the aforementioned embodiment, the shapes of the shoulder portion 12, the body 13, and the bottom portion 14 when viewed in the transverse section in the radial direction are set to the circular shape. However, without being limited thereto, the shapes of the shoulder portion 12, the body 13, and the bottom portion 14 when viewed in the transverse section in the radial direction may be appropriately changed into, for instance, a polygonal shape.

In the aforementioned embodiment, the example in which the panel portions 51 are formed at the portion that bypasses both ends of the intermediate part 13*a* of the body 13 in the direction of the bottle axis O has been described. However, without being limited thereto, the panel portions may be formed throughout the intermediate part 13*a* in the direction of the bottle axis O.

In the aforementioned embodiment, the depth H1 of the longitudinal lateral wall portion 54*a* is formed to be shorter than the depth H2 of the peripheral end wall portion 55*b*. On the other hand, the depth H2 of the peripheral end wall portion 55*b* may be formed to be short, compared to the depth H1 of the longitudinal lateral wall portion 54*a*.

In the aforementioned embodiment, the example in which the rib width D1 is greater than or equal to the pillar width D2 has been described. However, without being limited thereto, the pillar width D2 may be greater than the rib width D1, as in Sample 6.

In the aforementioned embodiment, the example in which one rib 55 is arranged on each panel bottom wall portion 53 has been described. However, without being limited thereto, a plurality of ribs 55 may be arranged on each panel bottom wall portion 53.

The synthetic resin material of which the bottle 1 is formed may be appropriately changed into, for instance, polyethylene terephthalate, polyethylene naphthalate, an amorphous polyester, or a blend material thereof.

The bottle 1 is not limited to the single layer structure but may be used as a laminated structure having an intermediate layer. The intermediate layer includes, for instance, a layer formed of a resin material having a gas barrier property, a layer formed of a recycled material, or a layer formed of a resin material having oxygen absorbability.

In addition, the components in the aforementioned embodiment can be appropriately substituted with well-known components without departing from the spirit and scope of the present invention. Further, the aforementioned modifications may be appropriately combined.

Second Embodiment

Hereinafter, a bottle according to a second embodiment of the present invention will be described with reference to the drawings.

As shown in FIGS. 14 to 17, the bottle 201 according to the present embodiment includes a mouth portion 211, a shoulder portion 212, a body 213, and a bottom portion 214. The mouth portion 211, the shoulder portion 212, the body 213, and the bottom portion 214 have a schematic constitution in which central axes thereof are placed on a common axis and are provided continuously in this order.

Hereinafter, the aforementioned common axis is referred to as a bottle axis O. In a direction of the bottle axis O, an area positioned near the mouth portion 211 is referred to as an upside, and an area positioned near the bottom portion 214 is referred to as a downside. A direction perpendicular to the bottle axis O is referred to as a radial direction, and a direction revolving around the bottle axis O is referred to as a circumferential direction.

The bottle 201 according to the present embodiment is integrally formed of a synthetic resin material by blow-molding a preform formed in a bottomed cylindrical shape by injection molding. Further, a cap (not shown) is mounted on the mouth portion 211. Each of the mouth portion 211, the shoulder portion 212, the body 213, and the bottom portion 214 has an approximately circular shape when viewed in a transverse section in the radial direction.

A first annular recessed groove 216 is continuously formed throughout the circumference of a connecting portion between the shoulder portion 212 and the body 213.

The body 213 is formed in a cylindrical shape. The body 213 is continuous with a lower end of the shoulder portion 212, and extends downward. An intermediate part 213*a* between both ends of the body 213 in the direction of the bottle axis O has a smaller diameter than both ends of the body 213. The intermediate part 213*a* of the body 213 is configured for a label such as a shrink label (not shown) to be wrapped therearound.

Figure 14:
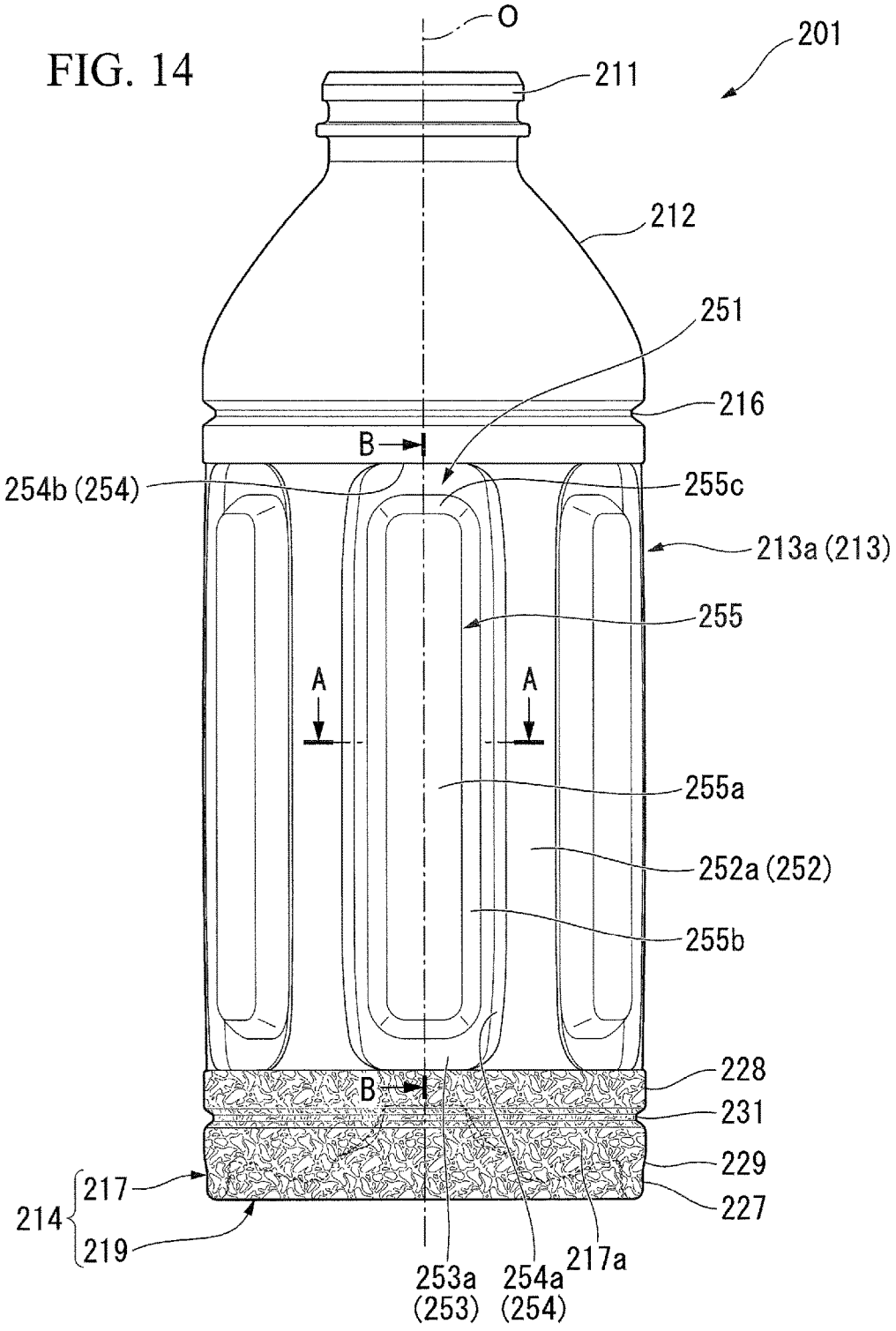
FIG. 14 is a side view of a bottle according to a second embodiment of the present invention.
Figure 16:
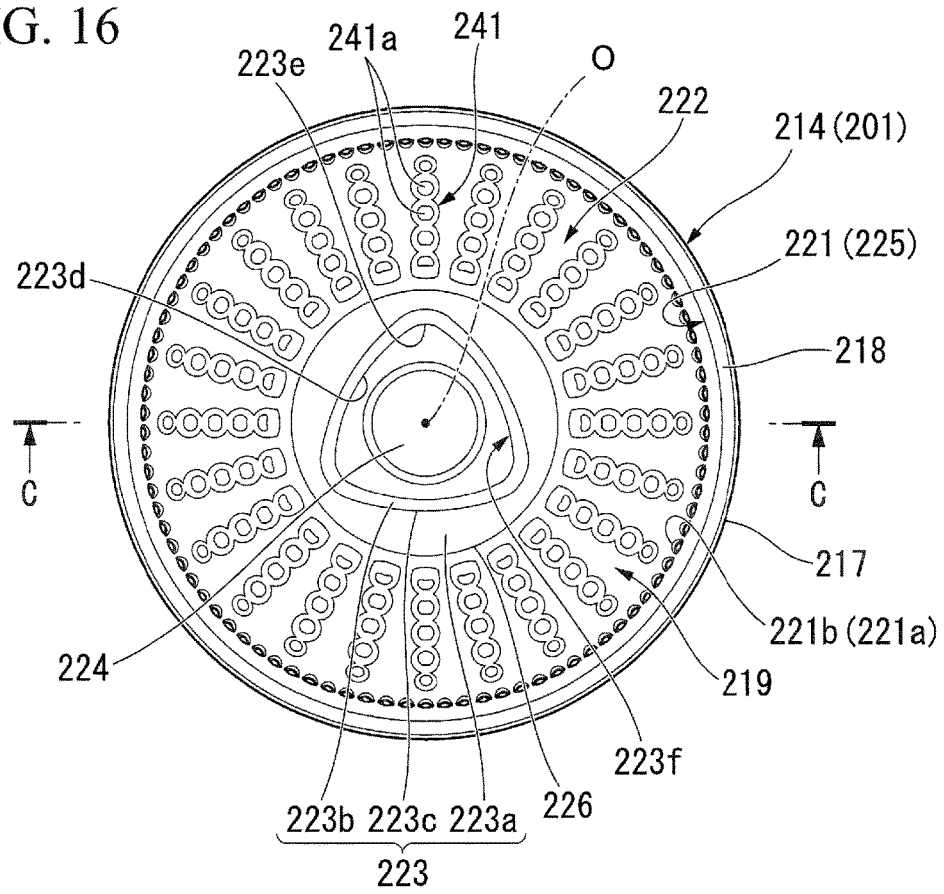
FIG. 16 is a bottom view of the bottle.
Figure 17:
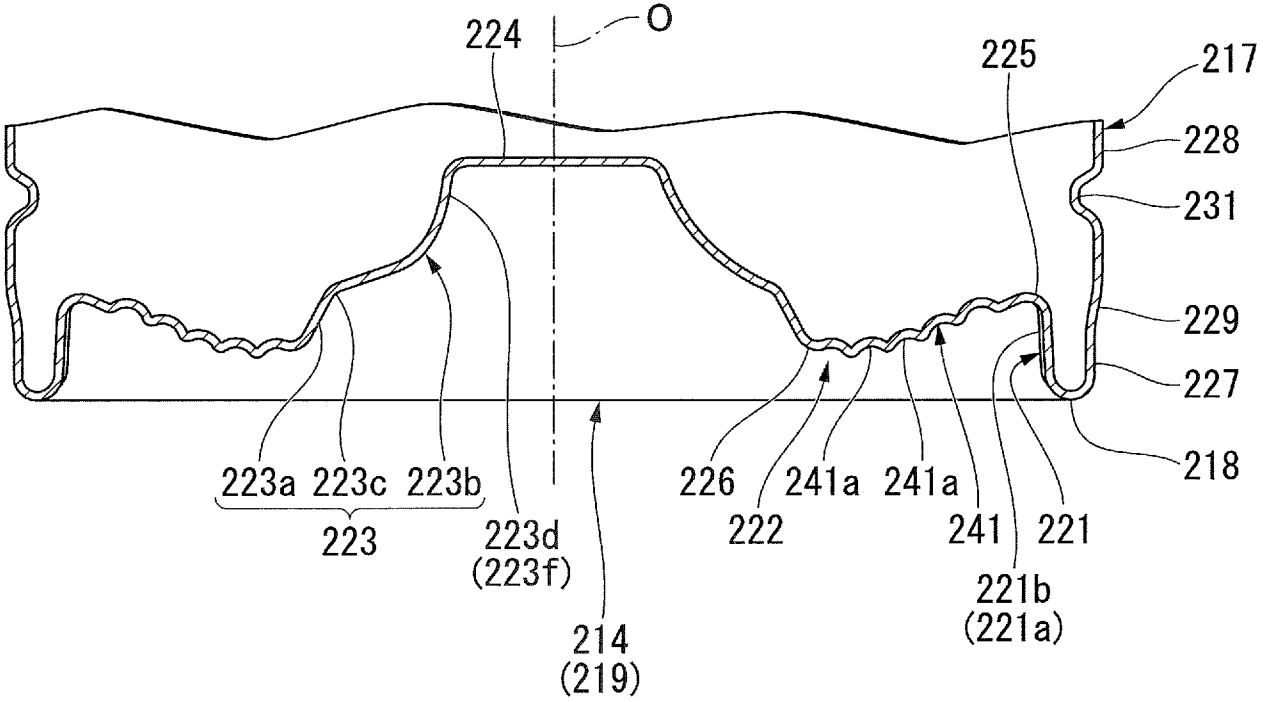
FIG. 17 is a cross-sectional view taken along line C-C of FIG. 16.

As shown FIGS. 14, 16 and 17, the bottom portion 214 is formed in a bottomed cylindrical shape, and includes a heel portion 217 and a bottom wall portion 219. An upper end opening part of the heel portion 217 is connected to a lower end opening part of the body 213. The bottom wall portion 219 closes a lower end opening part of the heel portion 217, and an outer circumferential edge thereof acts as a grounding portion 218.

The heel portion 217 includes a lower heel portion 227, an upper heel portion 228, and a connection portion 229. The lower heel portion 227 is continuous with the grounding portion 218 from an outside in the radial direction, and the upper heel portion 228 is continuous with the body 213 from below. The connection portion 229 connects the lower heel portion 227 and the upper heel portion 228.

The lower heel portion 227 is formed with a diameter smaller than that of the upper heel portion 228. The connection portion 229 has a constitution in which a diameter thereof is gradually reduced from top to bottom.

The upper heel portion 228 is a maximum outer diameter part at which an outer diameter of the bottle 201 is largest together with both ends of the body 213 in the direction of the bottle axis O. Further, an intermediate portion of the upper heel portion 228 in the direction of the bottle axis O has a second annular recessed groove 231 that is continuously formed throughout the circumference.

Further, an outer circumferential surface of the heel portion 217 and an outer circumferential surface of a lower end of the body 213 have an uneven portion 217*a* formed at a low protrusion height by, for instance, an embossing process.

As shown in FIGS. 16 and 17, the bottom wall portion 219 includes a standing peripheral wall portion 221, a movable wall portion 222 which has an annular shape, and a recessed circumferential wall portion 223. The standing peripheral wall portion 221 is continuous with the grounding portion 218 from an inside in the radial direction and extends upward. The movable wall portion 222 protrudes from an upper end of the standing peripheral wall portion 221 toward the radial inner side. The recessed circumferential wall portion 223 extends upward from a radial inner end of the movable wall portion 222.

The standing peripheral wall portion 221 is gradually reduced in diameter from bottom to top. The standing peripheral wall portion 221 has an uneven portion 221*a* formed throughout the circumference. The uneven portion 221*a* has a constitution in which a plurality of protrusions 221*b* formed in a shape of a curved surface protruding toward the inside in the radial direction are arranged at intervals in the circumferential direction.

The movable wall portion 222 is formed in a shape of a curved surface protruding downward, and gradually extends downward from the outside in the radial direction toward the inside in the radial direction. The movable wall portion 222 and the standing peripheral wall portion 221 are connected via a curved surface portion 225 protruding upward. Then, the movable wall portion 222 is configured to be rotatable around the curved surface portion 225, i.e., a portion connected to the standing peripheral wall portion 221, so as to cause the recessed circumferential wall portion 223 to move upward.

Further, the movable wall portion 222 has a plurality of ribs 241 radially arranged around the bottle axis O. Each rib 241 has a constitution in which a plurality of recesses 241*a* recessed upward in a curved surface shape are intermittently arranged in the radial direction.

The recessed circumferential wall portion 223 is arranged on the same axis as the bottle axis O. A top wall 224 disposed on the same axis as the bottle axis O is connected to an upper end of the recessed circumferential wall portion 223. A whole of recessed circumferential wall portion 223 and the top wall 224 is formed in a cylindrical shape having a top.

The recessed circumferential wall portion 223 is formed in a multistep cylindrical shape in which a diameter thereof is gradually increased from upward to downward. To be specific, the recessed circumferential wall portion 223 includes a lower tube part 223*a*, an upper tube part 223*b*, and an annular step part 223*c*. The lower tube part 223*a* is formed in such a manner that a diameter thereof is gradually reduced upward from a radial inner end of the movable wall portion 222. The upper tube part 223*b* is gradually increased in diameter downward from an outer circumferential edge of the top wall 224, and has a smaller diameter than the lower tube part 223*a*. The annular step part 223*c* interconnects both the tube parts 223*a* and 223*b*.

As shown in FIGS. 16 and 17, the lower tube part 223*a* is connected to the radial inner end portion of the movable wall portion 222 via a curved surface portion 226 protruding downward. The curved surface portion 226 protrudes in an obliquely downward and the inside in the radial direction. The lower tube part 223*a* is formed in a circular shape when viewed in a transverse section in the radial direction.

The annular step part 223*c* is formed in a shape of a concave curved surface recessed toward the outside in the radial direction. The annular step part 223*c* is located at a height higher than or equal to that of the upper end of the standing peripheral wall portion 221.

A plurality of overhanging parts 223*d* projecting to the inside in the radial direction are formed at the upper tube part 223*b*. The overhanging parts 223*d* are connected in the circumferential direction. Thereby, an angular tube part 223*f* is formed in such a manner that, as shown in FIG. 16, a shape viewed from the bottom is a polygonal shape in which portions 223*e* each located between the overhanging parts 223*d* adjacent to each other in the circumferential direction act as angular portions, and the overhanging parts 223*d* act as side portions.

The overhanging parts 223*d* are formed in the shape of a curved surface protruding toward the outside in the radial direction when viewed from the bottom. At the upper tube part 223*b* of the recessed circumferential wall portion 223, the plurality of overhanging parts 223*d* are disposed at intervals in the circumferential direction. In the present embodiment, three overhanging parts 223*d* are formed, and a shape of the angular tube part 223*f* when viewed from the bottom is an equilateral triangle shape. The overhanging parts 223*d* are formed in the shape of a curved surface protruding toward the inside in the radial direction in a longitudinal section along the direction of the bottle axis O shown in FIG. 16.

The portion 223*e* between the overhanging parts 223*d* is formed in a shape of a curved surface protruding toward the outside in the radial direction when viewed from the bottom. The portion 223*e* connects ends of the overhanging parts 223*d*, which are adjacent to each other in the circumferential direction, to each other in the circumferential direction.

Figure 15A:
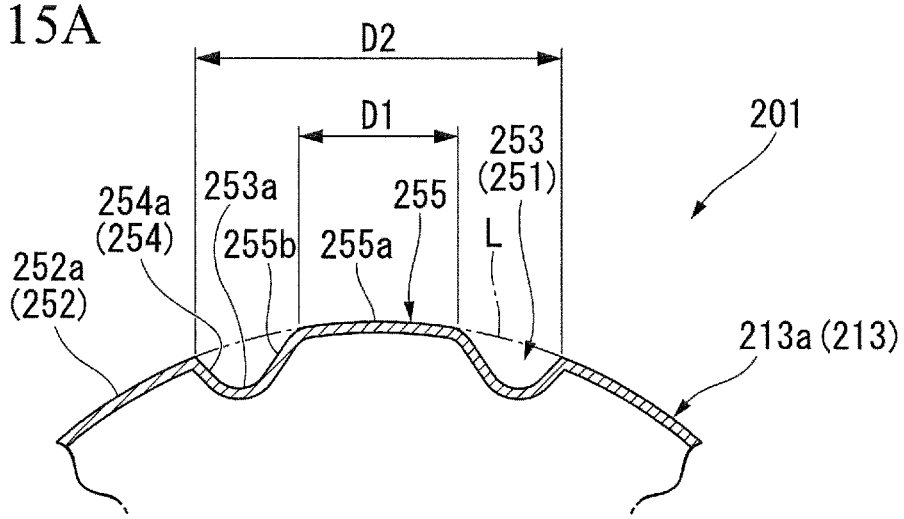
FIG. 15A is a cross-sectional view taken along line A-A of FIG. 14.
Figure 15B:
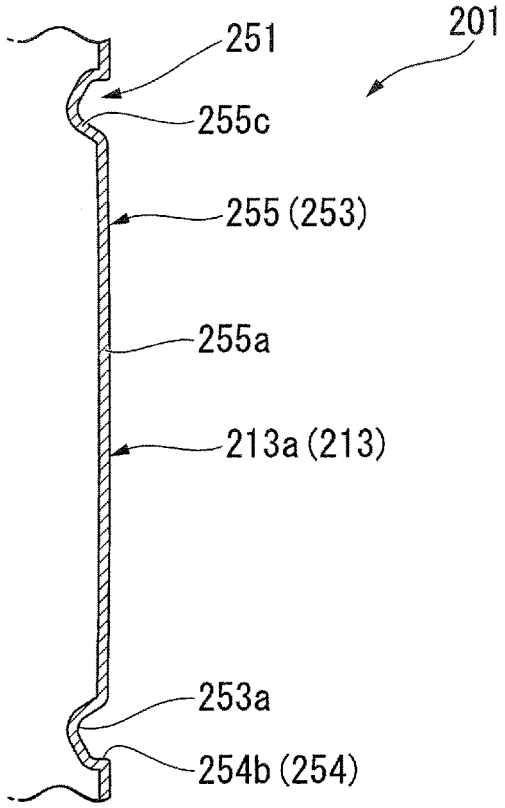
FIG. 15B is a cross-sectional view taken along line B-B of FIG. 14.

Here, as shown in FIGS. 14, 15A and 15B, a plurality of panel portions 251 for absorbing pressure reduction, which are recessed toward the inside in the radial direction, are formed on the intermediate part 213*a* of the aforementioned body 213. The panel parts 251 are formed at intervals in the circumferential direction. Portions of the body 213, each of which is located between the panel portions 251 adjacent to each other in the circumferential direction, constitute pillar portions 252 extending in the direction of the bottle axis O. In other words, the panel portions 251 of a concave shape and the pillar portions 252 of a convex shape are mutually arranged on the body 213 in the circumferential direction.

Each panel portion 251 has a bottom wall portion 253 and a lateral wall portion 254. The bottom wall portion 253 is formed in a rectangular shape in which the direction of the bottle axis O is set to a longitudinal direction when viewed from the outside in the radial direction. The lateral wall portion 254 is erected from an outer circumferential edge of the bottom wall portion 253 toward the outside in the radial direction, and encloses the bottom wall portion 253 throughout the circumference.

The lateral wall portion 254 has a pair of longitudinal lateral wall portions 254*a*. The pair of longitudinal lateral wall portions 254*a* is continuous with both ends of the panel bottom wall portion 253 in the circumferential direction and extends in the direction of the bottle axis O. The longitudinal lateral wall portions 254*a* of the lateral wall portions 254 are inclined surfaces that are inclined toward an outside in the circumferential direction, i.e., in a direction in which the pair of longitudinal lateral wall portions 254*a* constituting one panel portion 251 are spaced apart from each other, from the inside to the outside in the radial direction. The pillar portions 252 are each located between the longitudinal lateral wall portions 254*a* of the panel portions 251 adjacent to each other in the circumferential direction. A shape of the pillar portion 252 when viewed in a transverse section perpendicular to the bottle axis O is a trapezoidal shape in which a circumferential size is reduced from the inside to the outside in the radial direction. A top part 252*a* is located at an outside in the radial direction of the pillar portions 252. The top part 252*a* is formed in a shape of a curved surface protruding toward the outside in the radial direction. The top part 252*a* is an outermost diameter part at which an outer diameter of the intermediate part 213*a* is largest in the body 213.

The lateral wall portion 254 is provided with a pair of transverse lateral wall portions 254*b* so as to be located at both ends in the bottle axis O and to extend in the circumferential direction. The pair of transverse lateral wall portions 254*b* extend from the inside to the outside in the radial direction.

A rib 255 protruding toward the outside in the radial direction is formed at a middle part of the panel bottom wall portion 253. The rib 255 is formed in a rectangular shape in which the direction of the bottle axis O is set to a longitudinal direction when viewed from the outside in the radial direction, and is arranged with a gap between the lateral wall portion 254 and the rib 255 throughout the circumference. In other words, the rib 255 is arranged inside the panel portion 251 in an island shape.

When viewed in a transverse section in the radial direction of the rib 255 (see FIG. 15A), a top surface 255*a* located at the outside in the radial direction is formed in a shape of a curved surface protruding toward the outside in the radial direction. The top surface 255*a* is located on a virtual circle L extending in the circumferential direction according to a surface shape of each top part 252*a* at the plurality of pillar portions 252 and is an outermost diameter part of the intermediate part 213*a* in the body 213.

A rib width D1 in a tangential direction of the intermediate part 213*a* at the top surface 255*a* is set to 10% or more and 38.5% or less of a panel width D2 in a tangential direction of the intermediate part 213*a* at the panel portion 251.

Among wall portions by which the rib 255 is defined, a pair of longitudinal wall portions 255*b*, which are located at both ends in the circumferential direction and extend in the direction of the bottle axis O, are gradually inclined toward an inside in a circumferential direction in accordance with a position from the inside in the radial direction toward the outside in the radial direction. Among the wall portions by which the rib 255 is defined, a pair of transverse ribs 255*c*, which are located at both ends in the direction of the bottle axis O and extend in the circumferential direction, are gradually inclined from an outside thereof toward an inside in the direction of the bottle axis O in accordance with a position from the inside toward the outside in the radial direction. Accordingly, the rib 255 is formed in a trapezoidal shape in which its width in the direction of the bottle axis O and its width in the circumferential direction are gradually reduced from the inside toward the outside in the radial direction.

As shown in FIGS. 15A and 15B, a portion 253*a* of the bottom wall portion 253 which is connected to an inner circumferential edge of the lateral wall portion 254 is formed in a shape of a curved surface that is continuous with the inner circumferential edge of the lateral wall portion 254 and is depressed toward the inside of the radial direction when viewed in a longitudinal section in the direction of the bottle axis O (see FIG. 15B) and when viewed in a transverse section in the radial direction (see FIG. 15A).

In the present embodiment, when a pressure in the bottle 201 is reduced, the bottom wall portion 253 is displaced toward the inside of the radial direction centering on the connecting portion 253*a* between the bottom wall portion 253 and the lateral wall portion 254 at the panel portion 251. In other words, the panel portions 251 are preferentially deformed during the reduction in pressure, and thereby it is possible to absorb a change in internal pressure (a reduction in pressure) of the bottle 201 while suppressing deformation at other regions (e.g., the pillar portions 252 and the shoulder portion 212).

Moreover, in the present embodiment, since the rib 255 protruding toward the outside in the radial direction is formed at the bottom wall portion 253, a label wrapped around the body 213 so as to cover the panel portions 251 can be supported from the inside of the radial direction. For this reason, it is possible to restrict the label covering the panel portions 251 from moving to the inside in the radial direction when the label is mounted. Thereby, it is possible to prevent the label from being pulled into the panel portions 251 and to prevent the label from having a poor appearance.

Further, even when the panel portions 251 are deformed toward the inside of the radial direction during the reduction in pressure, the displacement of the label is suppressed. As a result, after desired pressure reduction-absorbing performance is maintained, it is possible to prevent the label wrapped around the body 213 from having a poor appearance.

Especially, the top surface 255*a* of the rib 255 is located on the virtual circle L extending in the circumferential direction according to the surface shape of each top part 252*a* of the plurality of pillar portions 252. For this reason, the label can be supported on the same surface as the pillar portion 252 at the rib 255. Thereby, in the label portion covering the panel portions 251, displacement of the label portion toward the inside of the radial direction can be reliably regulated.

In the present embodiment, the movable wall portion 222 is arranged to be rotatable around the curved surface portion 225 so as to cause the recessed circumferential wall portion 223 to move in the direction of the bottle axis O. For this reason, when the internal pressure of the bottle 201 is changed, the movable wall portion 222 is rotated to absorb a change in the internal pressure. Thereby, it is possible to suppress radial deformation of the shoulder portion 212 and the body 213. For this reason, it is possible to reliably prevent the label from having a poor appearance.

When the pressure reduction-absorbing performance caused by the movable wall portion 222 is sufficient, it can also be configured to preferentially displace the movable wall portion 222, and to suppress (prevent) the deformation of the panel portions 251.

In this case, it is possible to form, for instance, the rib width D1 as large as possible and to more reliably prevent the label from having a poor appearance.

Figure 18:
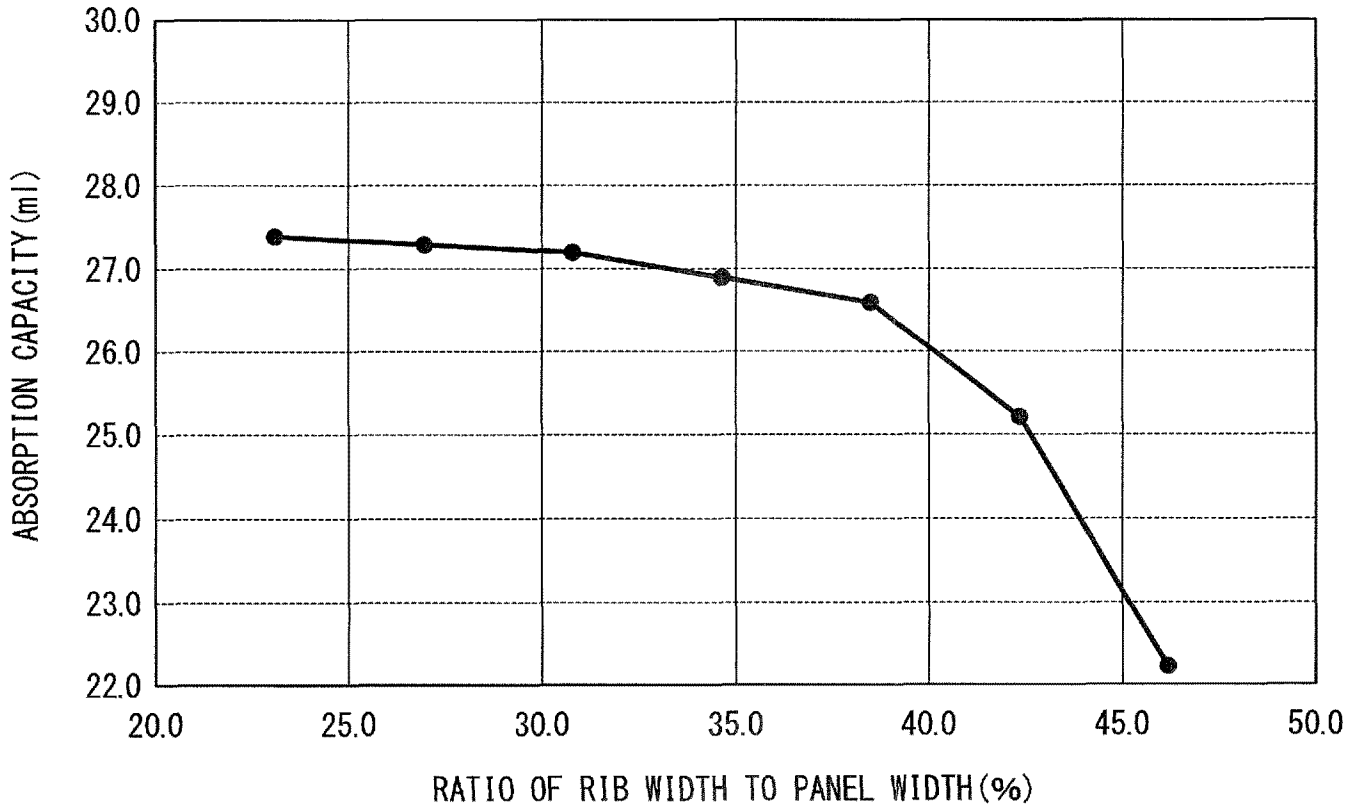
FIG. 18 is a graph showing a relation between a ratio (D1/D2) of a width dimension D1 of a rib to a panel width D2 and an absorption capacity (ml).

Here, it was verified as shown in FIG. 18 how a relation between a ratio (D1/D2) of the rib width D1 to the panel width D2 and an absorption capacity (ml) when the pressure in the bottle 201 is in a reduced state is changed. In the present verification, the bottle 201 in which an internal capacity is 500 ml, and six panel portions 251 of the same shape are uniformly disposed in the circumferential direction of the body 213 was used. Further, the bottom wall portion 219 was configured to be safe from substantial deformation during the reduction in pressure, and an absorption capacity of the panel portions 251 alone was verified by analysis.

In the present test, the ratio of the rib width D1 to the panel width D2 was adjusted by changing the rib width D1 within a range from 6 to 12 mm in units of 1 mm without changing the panel width D2. Specific conditions are as follows.

<Sample 21> Rib width D1=6 mm, and panel width D2=26 mm (D1/D2=23.1%)

<Sample 22> Rib width D1=7 mm, and panel width D2=26 mm (D1/D2=26.9%)

<Sample 23> Rib width D1=8 mm, and panel width D2=26 mm (D1/D2=30.8%)

<Sample 24> Rib width D1=9 mm, and panel width D2=26 mm (D1/D2=34.6%)

<Sample 25> Rib width D1=10 mm, and panel width D2=26 mm (D1/D2=38.5%)

<Sample 26> Rib width D1=11 mm, and panel width D2=26 mm (D1/D2=42.3%)

<Sample 27> Rib width D1=12 mm, and panel width D2=26 mm (D1/D2=46.2%)

As shown in FIG. 18, as the ratio of the rib width D1 to the panel width D2 increases, i.e., as the rib width D1 increases, the supporting portion of the label is expanded at the panel portions 251. As the result, the occurrence of the poor appearance of the label associated with the mounting of the label is reduced. On the other hand, it is found that the absorption capacity is reduced. To be specific, the absorption capacity in Samples 21 to 27 is 27.4 ml for Sample 21, 27.3 ml for Sample 22, 27.2 ml for Sample 23, 26.9 ml for Sample 24, 26.6 ml for Sample 25, 25.2 ml for Sample 26, and 22.2 ml for Sample 27.

Especially, when the ratio of the rib width D1 to the panel width D2 is higher than 38.5% (Samples 26 and 27), it is found that the absorption capacity is remarkably reduced. This is thought to be because, as the rib width D1 increases, the width of the bottom wall portion 253 is reduced, and displacement of the panel portions 251 is reduced during the reduction in pressure, and thus desired pressure reduction-absorbing performance cannot be exerted. In this case, without following an increase in pressure reduction intensity, there is a possibility of local deformation occurring at places other than the panel portions 251 in the course of reducing the pressure.

In contrast, when the ratio of the rib width D1 to the panel width D2 is lower than or equal to 38.5%, after the label is prevented from having a poor appearance, the absorption capacity of 26 ml or more can be maintained, and sufficient pressure reduction-absorbing performance can be exerted.

On the other hand, as the ratio of the rib width D1 to the panel width D2 was lowered (i.e. as the rib width D1 is reduced), the appearance was remarkably deformed even when sufficient pressure reduction-absorbing performance was exerted during the reduction in pressure. This is thought to be because, as the rib width D1 is reduced, the supporting portion of the label is reduced at the panel portions 251, and thus an interval between the rib 255 and the pillar portion 252 is increased, and the label wrapped around the body 213 easily moves to the inside of the radial direction toward the bottom wall portion 253 of the panel portion 251. To be specific, in Sample 21, the deformation of the appearance when a shrink label was mounted was not observed.

In contrast, when the ratio of the rib width D1 to the panel width D2 was less than 10%, the deformation of the appearance was observed from the mounted shrink label.

From the aforementioned results, the ratio of the rib width D1 to the panel width D2 is set to 10% or more and 38.5% or less. Thereby, after the desired pressure reduction-absorbing performance is maintained, it is possible to prevent the label wrapped around the body 213 from having a poor appearance.

While the embodiments of the present invention have been described in detail with reference to the drawings, a specific constitution is not limited to the embodiments, and a change in design is also included without departing from the spirit and scope of the present invention.

For example, with regard to the number and arrangement of panel portions 251 and pillar portions 252, an appropriate change in design is possible in consideration of the strength and pressure reduction-absorbing capacity required for the bottle 201.

In the aforementioned embodiment, the shapes of the shoulder portion 212, the body 213, and the bottom portion 214 when viewed in the transverse section in the radial direction are set to the circular shape. However, without being limited thereto, the shapes of the shoulder portion 212, the body 213, and the bottom portion 214 when viewed in the transverse section in the radial direction may be appropriately changed into, for instance, a polygonal shape.

In the aforementioned embodiment, the example in which the rib 255 is arranged throughout the circumference with the gap provided between the rib 255 and the lateral wall portion 254 has been described. However, without being limited thereto, the gap may be at least provided between the longitudinal lateral wall portion 254*a* and the rib 255.

Further, in the aforementioned embodiment, the example in which one rib 255 is arranged on each panel bottom wall portion 253 has been described. However, without being limited thereto, a plurality of ribs 255 may be arranged.

The synthetic resin material of which the bottle 201 is formed may be appropriately changed into, for instance, polyethylene terephthalate, polyethylene naphthalate, an amorphous polyester, or a blend material thereof.

The bottle 201 is not limited to the single layer structure but may be used as a laminated structure having an intermediate layer. The intermediate layer includes, for instance, a layer formed of a resin material having a gas barrier property, a layer formed of a recycled material, or a layer formed of a resin material having oxygen absorbability.

In addition, the components in the aforementioned embodiment can be appropriately substituted with well-known components without departing from the spirit and scope of the present invention. Further, the aforementioned modifications may be appropriately combined.

INDUSTRIAL APPLICABILITY

According to the present invention, a bottle in which, after desired pressure reduction-absorbing performance is maintained, it is possible to prevent a label mounted on a body from having a poor appearance is obtained.

DESCRIPTION OF REFERENCE NUMERALS

1, 201 bottle
13, 213 body
14, 214 bottom portion
18, 218 grounding portion
19, 219 bottom wall portion
21, 221 standing peripheral wall portion
22, 222 movable wall portion
23, 223 recessed circumferential wall portion
51, 251 panel portion
52, 252 pillar portion
53, 253 panel bottom wall portion
54, 254 lateral wall portion
54*a*, 254*a* longitudinal lateral wall portion
55, 255 rib
55*a*, 255*a* top wall portion
55*b*, 255*b* peripheral end wall portion
56 gap
D1 rib width (width dimension of rib)
D2 panel width (width dimension of panel)
L virtual circle
O bottle axis

The invention claimed is:

1. A bottle comprising a cylindrical body portion in which a plurality of panel portions, which is recessed toward an inside in a radial direction of the cylindrical body portion, are provided at intervals in a circumferential direction and in which pillar portions are each provided between the panel portions adjacent to each other in the circumferential direction, wherein the panel portions each have a panel bottom wall portion located at an inside of the cylindrical body portion in the radial direction and two lateral wall portions each extending from an outer circumferential edge of the panel bottom wall portion to an outside in the radial direction, a rib of the plurality of panel portions which protrudes toward the outside in the radial direction while having a gap with respect to a longitudinal lateral wall portion of each lateral wall portion is provided at the panel bottom wall portion, the longitudinal lateral wall portion is at least directed in the circumferential direction, the rib includes a top wall portion located at the outside in the radial direction, and peripheral end wall portions configured to connect circumferential outer ends of the top wall portion and the panel bottom wall portions, and the top wall portion of the rib has an outer surface when viewed in a transverse section in the radial direction, the outer surface located on a virtual circle that connects outer surfaces of top parts which are located at the outside in the radial direction of the plurality of pillar portions in the circumferential direction, the rib and the pillar portion of the cylindrical body portion have circumferential sizes greater than or equal to a circumferential size of a radial outer end opening part of the gap, the gap is defined by the longitudinal lateral wall portion, the peripheral end wall portion and a connecting portion that connects a radially inner end of the longitudinal lateral wall portion and a radially inner end of the peripheral end wall portion when viewed in a transverse section running in the radial direction, the longitudinal lateral wall portion inclines from a top part of the pillar portion toward the rib as the longitudinal lateral wall portion goes inward from outside of the bottle in the radial direction or extends in the radial direction without inclination, the connecting portion inclines from the longitudinal lateral wall portion toward the peripheral end wall portion as the connecting portion goes inward from the outside of the bottle in the radial direction, and the peripheral end wall portion inclines from the top wall portion of the rib toward the pillar portion as the peripheral end wall portion goes inward from the outside of the bottle in the radial direction.

2. The bottle according to claim 1, wherein the panel portions formed at intervals in the circumferential direction are four or more.

3. The bottle according to claim 1, wherein the rib is formed throughout a length of the panel bottom wall portion in a direction of a bottle axis.

4. The bottle according to claim 3, wherein a position of a radial inner end of the longitudinal lateral wall portion and a position of a radial inner end of the peripheral end wall portion of the rib are different in the radial direction.

5. The bottle according to claim 4, wherein the radial inner end of the peripheral end wall portion is located at more inside in the radial direction than the radial inner end of the longitudinal lateral wall portion.

6. The bottle according to claim 5, wherein:

the bottle has an internal capacity 280 ml or more and 1000 ml or less; and a radial distance between the radial inner end of the longitudinal lateral wall portion and the radial inner end of the peripheral end wall portion of the rib ranges from 1.0 mm. to 2.0 mm.

7. The bottle according to claim 5, wherein the rib and the pillar portion are formed in line symmetry with respect to a central line passing through circumferential centers thereof when viewed in a transverse section in the radial direction.

8. The bottle according to claim 4, wherein:

the bottle has an internal capacity 280 ml or more and 1000 ml or less; and a radial distance between the radial inner end of the longitudinal lateral wall portion and the radial inner end of the peripheral end wall portion of the rib ranges from 1.0 mm. to 2.0 mm.

9. The bottle according to claim 4, wherein the rib and the pillar portion are formed in line symmetry with respect to a central line passing through circumferential centers thereof when viewed in a transverse section in the radial direction.

10. The bottle according to claim 1, wherein a position of a radial inner end of the longitudinal lateral wall portion and a position of a radial inner end of the peripheral end wall portion of the rib are different in the radial direction.

11. The bottle according to claim 10, wherein the radial inner end of the peripheral end wall portion is located at more inside in the radial direction than the radial inner end of the longitudinal lateral wall portion.

12. The bottle according to claim 11, wherein:

the bottle has an internal capacity 280 ml or more and 1000 ml or less; and a radial distance between the radial inner end of the longitudinal lateral wall portion and the radial inner end of the peripheral end wall portion of the rib ranges from 1.0 mm. to 2.0 mm.

13. The bottle according to claim 11, wherein the rib and the pillar portion are formed in line symmetry with respect to a central line passing through circumferential centers thereof when viewed in a transverse section in the radial direction.

14. The bottle according to claim 10, wherein:

the bottle has an internal capacity 280 ml or more and 1000 ml or less; and a radial distance between the radial inner end of the longitudinal lateral wall portion and the radial inner end of the peripheral end wall portion of the rib ranges from 1.0 mm. to 2.0 mm.

15. The bottle according to claim 10, wherein the rib and the pillar portion are formed in line symmetry with respect to a central line passing through circumferential centers thereof when viewed in a transverse section in the radial direction.

16. The bottle according to claim 1, wherein a top surface which is located at the outside of the rib in the radial direction is located on a virtual circle when viewed in a transverse section in the radial direction, the virtual circle connects top parts of the pillar portions which are located at the outside in the radial direction in the circumferential direction.

17. The bottle according to claim 16, wherein a rib width in the tangential direction of an outer periphery of a virtual circle of an intermediate part at a top surface of the rib is set to 10% or more and 38.5% or less of a panel width in a tangential direction of an outer periphery of a virtual circle of an intermediate part at the top surface of the rib.

18. The bottle according to claim 1, wherein:

the rib is formed throughout a length of the panel bottom wall portion in a direction of a bottle axis.

19. The bottle according to claim 1, further comprising a bottom portion continuous with a lower end of the cylindrical body portion and configured to close a lower end opening part of the cylindrical body portion, wherein a bottom wall portion of the bottom portion includes:

a grounding portion located at an outer circumferential edge;

a standing peripheral wall portion continuous with the grounding portion from the inside in the radial direction and configured to extend upward;

a movable wall portion which has an annular shape and is configured to protrude from an upper end of the standing peripheral wall portion toward the inside in the radial direction; and a recessed circumferential wall portion configured to extend upward from a radial inner end of the movable wall portion, and the movable wall portion is arranged to be rotatable around a portion connected to the standing peripheral wall portion so as to cause the recessed circumferential wall portion to move in an upward-downward direction.

20. The bottle according to claim 1, wherein a width dimension of the panel portion in the circumferential direction is greater than a width dimension of the pillar portion in the circumferential direction.

* * * * *